US009995513B2

(12) United States Patent
Baba

(10) Patent No.: US 9,995,513 B2
(45) Date of Patent: Jun. 12, 2018

(54) REFRIGERANT EVAPORATOR

(71) Applicant: DENSO CORPORATION, Kariya, Aichi-pref. (JP)

(72) Inventor: Norimasa Baba, Toyoake (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 456 days.

(21) Appl. No.: 14/436,978

(22) PCT Filed: Sep. 26, 2013

(86) PCT No.: PCT/JP2013/005703
§ 371 (c)(1),
(2) Date: Apr. 20, 2015

(87) PCT Pub. No.: WO2014/068842
PCT Pub. Date: May 8, 2014

(65) Prior Publication Data

US 2015/0285544 A1 Oct. 8, 2015

(30) Foreign Application Priority Data

Oct. 31, 2012 (JP) ..... 2012-240025

(51) Int. Cl.
*F25B 39/02* (2006.01)
*F28F 9/26* (2006.01)
(Continued)

(52) U.S. Cl.
CPC ..... *F25B 39/02* (2013.01); *F25B 39/028* (2013.01); *F28D 1/05391* (2013.01);
(Continued)

(58) Field of Classification Search
CPC .. F28D 1/0408; F28D 1/05325; F28D 1/0435; F28D 1/05391; F28F 9/0204;
(Continued)

(56) References Cited

U.S. PATENT DOCUMENTS 7,367,203 B2 * 5/2008 Katoh ..... F25B 39/02 62/515
2004/0206490 A1 * 10/2004 Katoh ..... F25B 39/02 165/174
(Continued)

FOREIGN PATENT DOCUMENTS

JP 2004044851 A 2/2004
JP 2005195316 A 7/2005
(Continued)

OTHER PUBLICATIONS

International Search Report and Written Opinion (in Japanese with English Translation) for PCT/JP2013/005703, dated Jan. 7, 2014; ISA/JP.

*Primary Examiner* — Jianying Atkisson
*Assistant Examiner* — For K Ling
(74) *Attorney, Agent, or Firm* — Harness, Dickey & Pierce, P.L.C.

(57) ABSTRACT

Provided in an interior of a leeward tank unit of a leeward evaporation portion is a refrigerant flow changing portion that guides a refrigerant from a first refrigerant collecting portion to a second refrigerant distributing portion and guides a refrigerant from a second refrigerant collecting portion to a first refrigerant distributing portion. The refrigerant flow changing portion is configured such that a refrigerant flow guided from the first refrigerant collecting portion to the second refrigerant distributing portion and a refrigerant flow guided from the second refrigerant collecting portion to the first refrigerant distributing portion are in a non-crossed state when viewed from a longitudinal direction of tubes.

3 Claims, 14 Drawing Sheets

(51) Int. Cl.
*F28F 9/02* (2006.01)
*F28D 1/053* (2006.01)

(52) U.S. Cl.
CPC ..... *F28F 9/028* (2013.01); *F28F 9/0273* (2013.01); *F28F 9/26* (2013.01)

(58) Field of Classification Search
CPC . F28F 9/028; F28F 9/26; F28F 9/0273; F25B 39/02; F25B 39/028
USPC ..... 165/174, 176; 62/525
See application file for complete search history.

(56) References Cited

U.S. PATENT DOCUMENTS

| | | | | |
|---|---|---|---|---|
| 2007/0074861 | A1 | 4/2007 | Higashiyama | |
| 2008/0078537 | A1* | 4/2008 | Desai | F28D 1/0435 165/140 |
| 2009/0025914 | A1 | 1/2009 | Knight et al. | |
| 2010/0031698 | A1 | 2/2010 | Higashiyama | |
| 2011/0303401 | A1* | 12/2011 | Kamoshida | B60H 1/00335 165/173 |
| 2012/0096894 | A1* | 4/2012 | Higashiyama | F25B 39/02 62/525 |

FOREIGN PATENT DOCUMENTS

| | | | |
|---|---|---|---|
| JP | 2006010263 | A | 1/2006 |
| JP | 2006029697 | A | 2/2006 |
| JP | 4124136 | B2 | 7/2008 |
| JP | 2010038447 | A | 2/2010 |

* cited by examiner

COMPARATIVE EXAMPLE

FIG. 6 COMPARATIVE EXAMPLE

REFRIGERANT EVAPORATOR

CROSS REFERENCE TO RELATED APPLICATIONS

This application is a U.S. National Phase Application under 35 U.S.C. 371 of International Application No. PCT/JP2013/005703 filed on Sep. 26, 2013 and published in Japanese as WO 2014/068842 A1 on May 8, 2014. This application is based on and claims the benefit of priority from Japanese Patent Application No. 2012-240025 filed on Oct. 31, 2012. The entire disclosures of all of the above applications are incorporated herein by reference.

TECHNICAL FIELD

The present disclosure relates to a refrigerant evaporator that cools a cooling target fluid by absorbing heat from the cooling target fluid and causes refrigerant to evaporate.

BACKGROUND ART

Examples of the known refrigerant evaporator include a configuration in which first and second evaporation portions are arranged in line in a flowing direction of the cooling target fluid. The first and second evaporation portions each includes a core portion having multiple stacked tubes, and a pair of tank units connected to both end portions of the multiple tubes. One of the tank units of each evaporation portion is coupled to each other through a pair of communicating portions (for example, see Patent Document 1).

In the refrigerant evaporator disclosed in Patent Document 1, when a refrigerant flows from a core portion of the first evaporation portion to a core portion of the second evaporation portion through one of the tank units of each evaporation portion and the pair of communicating portions that couples the tank units, the flow of the refrigerant is switched in the width direction (tube stacking direction, or right-left direction) of the core portions. In other words, the refrigerant evaporator is configured to make a refrigerant flow from one side of the core portion of the first evaporation portion in the width direction to an opposite side of the core portion of the second evaporation portion in the width direction through one of the pair of communicating portions, and make a refrigerant flow from another side of the core portion of the first evaporation portion in the width direction to an opposite side of the core portion of the second evaporation portion in the width direction through the other communication portion.

Also, in the refrigerant evaporator of Patent Document 1, the pair of communicating portions is an intersecting communicating portion in which the refrigerant flows intersect with each other leftward and rightward. The intersecting communicating portion is disposed in the tank unit of the first evaporation portion or the second evaporation portion, or in an intermediate tank provided between the tank unit of the first evaporation portion and the tank unit of the second evaporation portion.

PRIOR ART DOCUMENT

Patent Document

Patent Document 1: Japanese Patent No. 4124136

SUMMARY OF THE INVENTION

However, according to studies of the inventors of the present application, if an intersecting communicating portion is provided in an intermediate tank as in the refrigerant evaporator described in Patent Document 1 described above, an internal capacity of a refrigerant evaporator is increased by the provision of the intermediate tank, and hence an increase in refrigerant sealing amount may result.

If the intersecting communicating portion is provided in a tank unit of the first evaporation portion or the second evaporation portion, the intersecting communicating portion needs to be disposed between the adjacent tubes, and hence a cross-section of a refrigerant passage of the intersecting communicating portion becomes small. Therefore, a pressure loss of the refrigerant generating when passing through the intersecting communicating portion is increased, and hence a cooling performance of the cooling target fluid in the refrigerant evaporator may be lowered.

In view of the above-described point, it is an objective of the present disclosure is to provide a refrigerant evaporator capable of switching refrigerant flows in a width direction of a core portion while restricting an increase in refrigerant sealing amount, and further capable of improving a capacity to cool a cooling target fluid.

According to a first aspect of the present disclosure, a refrigerant evaporator, in which heat exchange is performed between a cooling target fluid flowing outside and a refrigerant, includes a first evaporation portion and a second evaporation portion which are arranged in line in a flowing direction of the cooling target fluid. The first evaporation portion includes a core portion having a plurality of stacked tubes in which the refrigerant flows, and a pair of tank units connected to both ends of the plurality of tubes and configured to perform collection or distribution of the refrigerant flowing in the plurality of tubes. The second evaporation portion includes a core portion having a plurality of stacked tubes in which the refrigerant flows, and a pair of tank units connected to both ends of the plurality of tubes and configured to perform collection or distribution of the refrigerant flowing in the plurality of tubes. The core portion of the first evaporation portion includes a first core portion having a group of the plurality of tubes, and a second core portion having another remaining group of the plurality of tubes. The core portion of the second evaporation portion includes a third core portion having a group of the plurality of tubes opposing at least a part of the first core portion in the flowing direction of the cooling target fluid, and a fourth core portion having a group of the plurality of tubes opposing at least a part of the second core portion in the flowing direction of the cooling target fluid. A first tank unit, which is one of the pair of tank units of the first evaporation portion, includes a first refrigerant collecting portion in which the refrigerant is collected from the first core portion, and a second refrigerant collecting portion in which the refrigerant is collected from the second core portion. A second tank unit, which is one of the pair of tank units of the second evaporation portion, includes a first refrigerant distributing portion from which the refrigerant is distributed to the third core portion, and a second refrigerant distributing portion from which the refrigerant is distributed to the fourth core portion. The second refrigerant collecting portion and the first refrigerant distributing portion are connected through a first communicating portion. The first refrigerant collecting portion and the second refrigerant distributing portion are connected through a second communicating portion. At least one of the first tank unit of the first evaporation portion and the second tank unit of the second evaporation portion includes therein a refrigerant flow changing portion guiding the refrigerant from the first refrigerant collecting portion to the second refrigerant distributing portion and guiding the refrigerant from the second refrigerant collecting portion to the first refrigerant distributing portion. The refrigerant flow changing portion is configured such that the refrigerant flow from the first refrigerant collecting portion to the second refrigerant distributing portion and the refrigerant flow from the second refrigerant collecting portion to the first refrigerant distributing portion are in a non-crossed state when viewed in a longitudinal direction of the tubes.

In this configuration, the refrigerant flow changing portion configured to guide the refrigerant in the first refrigerant collecting portion into the second refrigerant distributing portion, and guide the refrigerant in the second refrigerant collecting portion into the first refrigerant distributing portion is provided in the interior of at least one of the first tank unit of the first evaporation portion and the second tank unit of the second evaporation portion. Accordingly, a flowing direction of the refrigerant can be switched in a width direction of the core portion in at least one of the tank units. In this case, a separate member (e.g., the intersecting communicating portion and the intermediate tank) other than the tank unit is not necessarily provided in order to switch the flowing direction of the refrigerant. Therefore, the flowing direction of the refrigerant can be switched in the width direction of the core portion while restricting increase in refrigerant sealing amount.

In addition, the refrigerant flow changing portion is configured such that the refrigerant flow guided from the first refrigerant collecting portion to the second refrigerant distributing portion and the refrigerant flow guided from the second refrigerant collecting portion to the first refrigerant distributing portion are in the non-crossed state when viewed in the longitudinal direction of the tubes. Hence, there is no need to arrange the intersecting communicating portion between the adjacent tubes. Therefore, an increase in pressure loss of the refrigerant can be limited when the flowing direction of the refrigerant is switched in the width direction of the core portion. Therefore, a capacity to cool the cooling target fluid in the refrigerant evaporator can be improved.

Here, in the second core portion of the first evaporation portion, the refrigerant can hardly flow to a tube of the multiple tubes of the second core portion that is located on an end portion opposite from a refrigerant inflow portion in the tube stacking direction, and hence a refrigerant distributing property tends to be deteriorated.

According to a second aspect of the present disclosure, the second communicating portion through which the first refrigerant collecting portion and the second refrigerant distributing portion communicate with each other may be connected to one end of the second tank unit of the second evaporation portion in the tube stacking direction. In this case, the one end portion of the second tank unit is farther from the refrigerant inflow portion than another end of the second tank unit in the stacking direction of the tubes is from the refrigerant inflow portion.

In this configuration, in the second evaporation portion, the refrigerant can be made to flow into the core portion from the end of the second tank unit that is opposite from the refrigerant inflow portion in the tube stacking direction. Therefore, the refrigerant flows easily into the tube located in the end portion of the fourth core portion of the second evaporation portion that is opposite from the refrigerant inflow portion in the tube stacking direction.

Therefore, when the refrigerant evaporator is viewed from the flowing direction of the cooling target fluid, a liquid-phase refrigerant flows over the entire area of a portion where the second core portion of the first evaporation portion and the fourth core portion of the second evaporation portion overlap each other. In this manner, in the refrigerant evaporator to which the liquid-phase refrigerant is distributed, any one of the core portions absorbs the calorific power corresponding to an evaporative latent heat of the refrigerant from the cooling target fluid. Hence, the cooling target fluid can be cooled sufficiently. Consequently, generation of an unbalanced temperature distribution in cooling target fluid passing through the refrigerant evaporator can be restricted.

According to a third aspect of the present disclosure, a refrigerant evaporator in which heat exchange is performed between a cooling target fluid flowing outside and a refrigerant, includes a first evaporation portion and a second evaporation portion which are arranged in line in a flowing direction of the cooling target fluid. The first evaporation portion includes a core portion having a plurality of stacked tubes in which the refrigerant flows, and a pair of tank units connected to both ends of the plurality of tubes and configured to perform collection or distribution of the refrigerant flowing in the plurality of tubes. The second evaporation portion includes a core portion having a plurality of stacked tubes in which the refrigerant flows, and a pair of tank units connected to both ends of the plurality of tubes and configured to perform collection or distribution of the refrigerant flowing in the plurality of tubes. The core portion of the first evaporation portion includes a first core portion having a group of the plurality of tubes, and a second core portion having another remaining group of the plurality of tubes. The core portion of the second evaporation portion includes a third core portion having a group of the plurality of tubes opposing at least a part of the first core portion in the flowing direction of the cooling target fluid, and a fourth core portion having a group of the plurality of tubes opposing at least a part of the second core portion in the flowing direction of the cooling target fluid. A first tank unit, which is one of the pair of tank units of the first evaporation portion, includes a first refrigerant collecting portion in which the refrigerant is collected from the first core portion, and a second refrigerant collecting portion in which the refrigerant is collected from the second core portion. A third tank unit, which is another of the pair of tank units of the first evaporation portion, includes a refrigerant inflow portion configured to introduce the refrigerant into the interior of the third tank unit. The refrigerant inflow portion is located at a position closer to the first core portion than to the second core portion. A second tank unit, which is one of the pair of tank units of the second evaporation portion, is connected to a first communicating portion through which the refrigerant flows from the second refrigerant collecting portion into the second tank unit, and a second communicating portion through which the refrigerant flows from the first refrigerant collecting portion into the second tank unit. The first communicating portion and the second communicating portion are arranged on the second tank unit of the second evaporation portion at positions corresponding to the fourth core portion. The first communicating portion is arranged to be closer to the third core portion than the second communicating portion is to the third core portion. At least one of the first tank unit of the first evaporation portion and the second tank unit of the second evaporation portion includes therein a refrigerant flow changing portion guiding the refrigerant from the first refrigerant collecting portion to the second communicating portion and guiding the refrigerant from the second refrigerant collecting portion to the first communicating portion. The refrigerant flow changing portion is configured such that the refrigerant flow from the first refrigerant collecting portion to the second communicating portion and the refrigerant flow from the second refrigerant collecting portion to the first communicating portion are in a non-crossed state when viewed from a longitudinal direction of the tubes.

In this configuration, the refrigerant flow changing portion that guides the refrigerant in the first refrigerant collecting portion into the second communicating portion, and guides the refrigerant in the second refrigerant collecting portion into the first communicating portion is provided in an interior of at least one of the first tank unit of the first evaporation portion and the second tank unit of the second evaporation portion. Accordingly, the flowing direction of the refrigerant can be switched in a width direction of the core portion in at least one of the tank units. In this case, a separate member other than the tank units is not necessarily provided in order to switch the flowing direction of the refrigerant. Therefore, the flowing direction of the refrigerant can be switched in the width direction of the core portion while restricting the increase in refrigerant sealing amount.

In addition, the refrigerant flow changing portion is configured such that the refrigerant flow guided from the first refrigerant collecting portion to the second tank unit of the second evaporation portion through the second communicating portion and the refrigerant flow guided from the second refrigerant collecting portion to the second tank unit of the second evaporation portion through the first communicating portion are in a non-crossed state when being viewed in the longitudinal direction of the tube. Hence, there is no need to arrange the intersecting communicating portion between the adjacent tubes. Therefore, an increase in pressure loss of the refrigerant can be limited when the flowing direction of the refrigerant is switched in the width direction of the core portion. Therefore, the capacity to cool the cooling target fluid in the refrigerant evaporator can be improved.

Furthermore, the first communicating portion and the second communicating portion are each connected to the positions corresponding to the tubes which belong to the fourth core portion of the second tank unit of the second evaporation portion. Hence, the refrigerant can be made to flow into the core portion from the second tank unit through an area (area corresponding to the fourth core portion) of the second tank unit that is opposite from the refrigerant inflow portion in the tube stacking direction in the second evaporation portion. Therefore, the refrigerant flows intensively into the tubes located in the end portion opposite from the refrigerant inflow portion in the tube stacking direction of the second evaporation portion.

Accordingly, when the refrigerant evaporator is viewed from the flowing direction of the cooling target fluid, a liquid-phase refrigerant flows over the entire area of the portion where the second core portion of the first evaporation portion and the fourth core portion of the second evaporation portion overlap each other. In this manner, in the refrigerant evaporator to which the liquid-phase refrigerant is distributed, any one of the core portions absorbs the calorific power corresponding to an evaporative latent heat of the refrigerant from the cooling target fluid. Hence, the cooling target fluid can be cooled sufficiently. Consequently, generation of the unbalanced temperature distribution in cooling target fluid passing through the refrigerant evaporator can be restricted.

EMBODIMENTS FOR EXPLOITATION OF THE INVENTION

Figure 1:
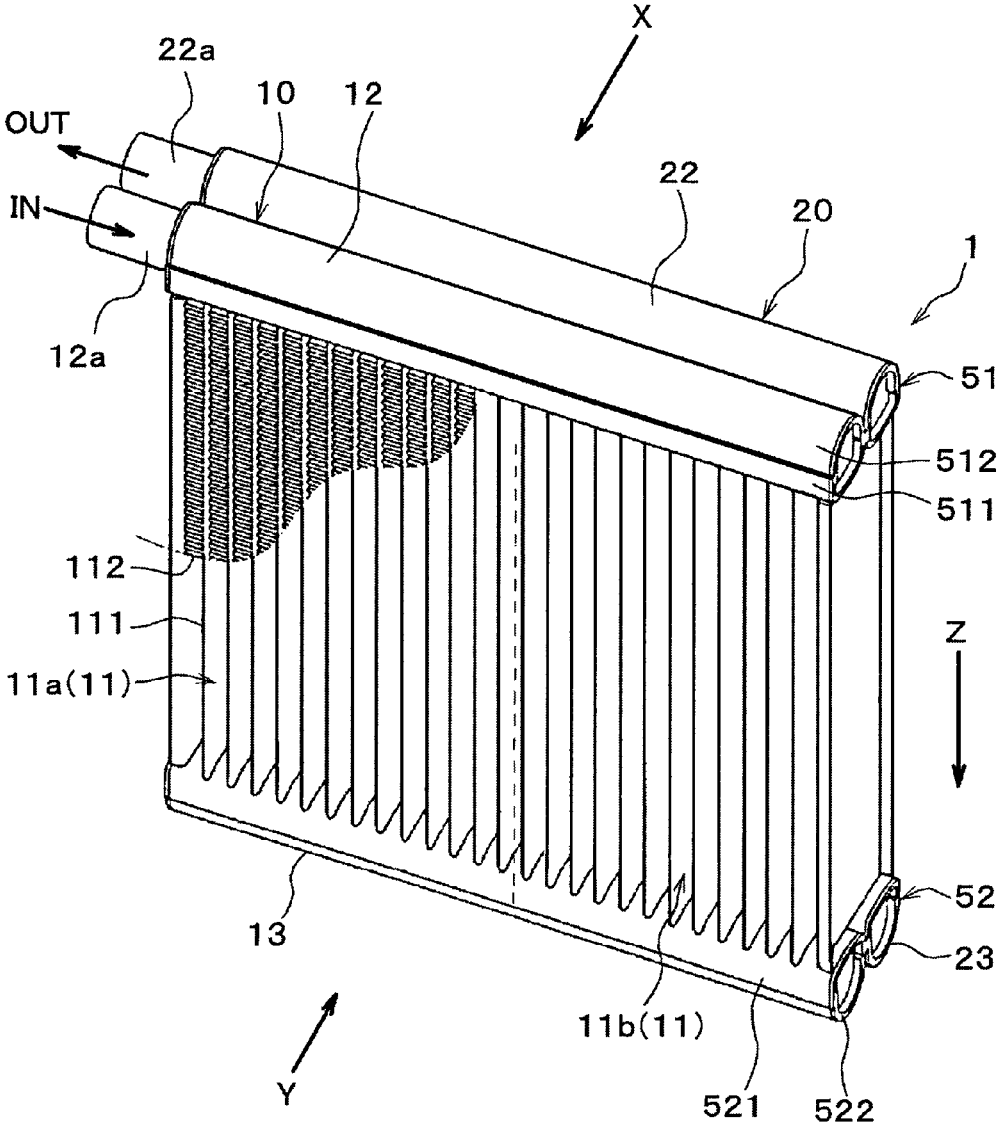
FIG. 1 is a schematic perspective view illustrating a refrigerant evaporator according to a first embodiment of the present disclosure.

Hereinafter, multiple embodiments for implementing the present invention will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

(First Embodiment)

A first embodiment of the present disclosure will be described with reference to FIG. 1 to FIG. 7. A refrigerant evaporator 1 according to the present embodiment is a cooling heat exchanger that is applied to a refrigeration cycle of a vapor compression type in a vehicle air conditioning system for regulating a temperature within a vehicle interior, and absorbs heat from a blast air which is blown into the vehicle interior and evaporates refrigerant (liquid-phase refrigerant) to cool the blast air. The blast air may be used as an example of a cooling target fluid flowing outside.

As well known, the refrigeration cycle includes a compressor, a radiator (condenser), and an expansion valve not shown, in addition to the refrigerant evaporator 1. In the present embodiment, the refrigeration cycle is configured as a receiver cycle in which a liquid receiver is arranged between the radiator and the expansion valve.

Figure 2:
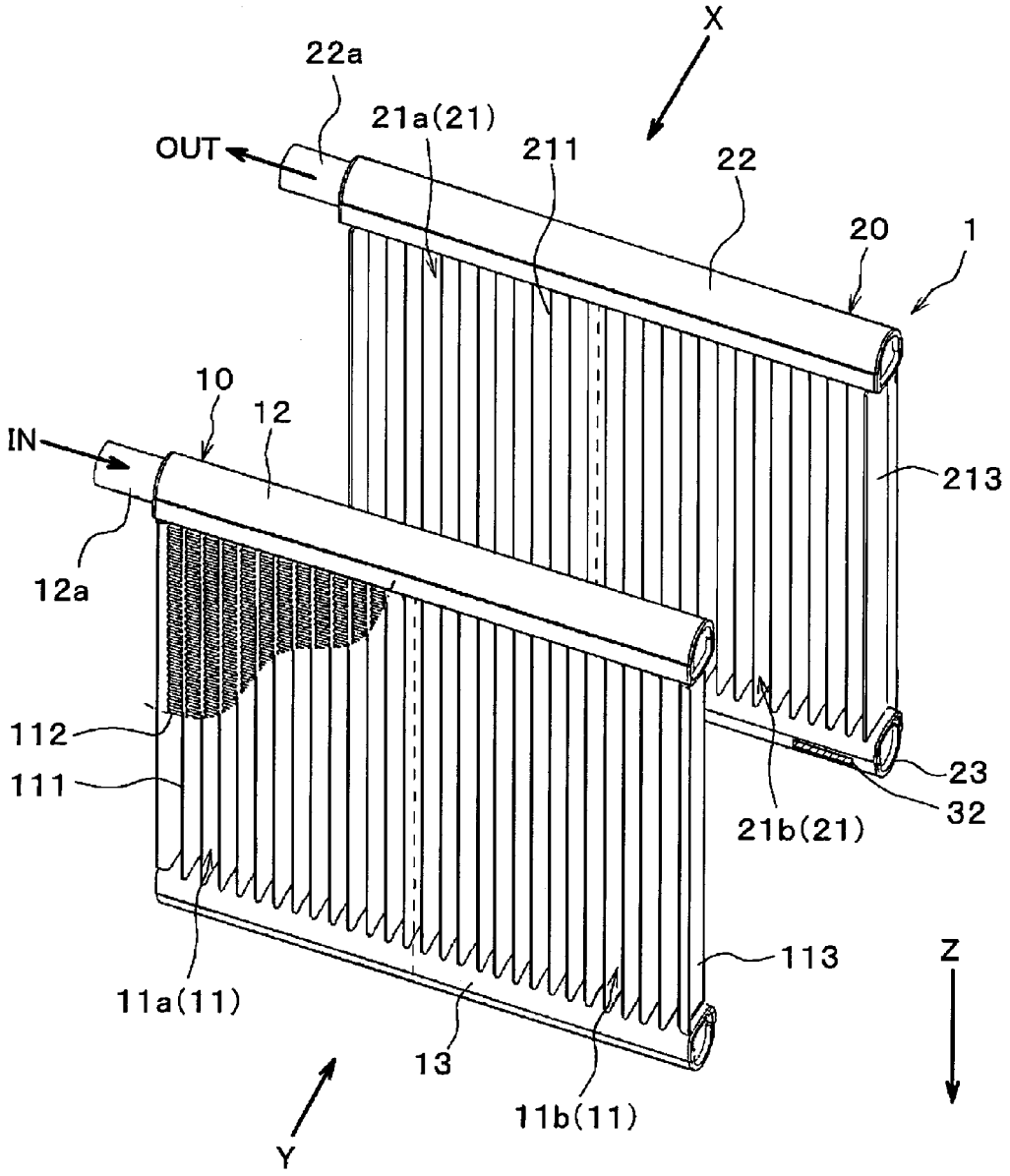
FIG. 2 is an exploded perspective view illustrating the refrigerant evaporator according to the first embodiment.

As illustrated in FIG. 1 and FIG. 2, the refrigerant evaporator 1 according to the present embodiment includes two evaporation portions 10, 20 arranged in line in a flowing direction of the blast air (flow direction of a cooling target fluid) X. Here, in the present embodiment, an evaporation portion of the two evaporation portions 10, 20, which is arranged on a leeward side (downstream side) in a flowing direction of the blast air is referred to as a leeward evaporation portion 10 (first evaporation portion), and an evaporation portion which is arranged on a windward (upstream side) in the flowing direction of the blast air is referred to as a windward evaporation portion 20 (second evaporation portion).

The leeward evaporation portion 10 and the windward evaporation portion 20 basically have the same configuration, and each includes core portions 11, 21 and pairs of tank units 12, 13, 22, 23 arranged on both upper and lower sides of the core portions 11, 21.

In the present embodiment, the core portion of the leeward evaporation portion 10 is referred to as a leeward core portion 11, and the core portion of the windward evaporation portion 20 is referred to as a windward core portion 21. The tank unit out of a pair of tank units 12, 13 in the leeward evaporation portion 10, which is arranged on an upper side, is referred to as a first leeward tank unit 12 (third tank unit), and the tank unit configured to be arranged on the lower side is referred to as a second leeward tank unit 13 (first tank unit). In the same manner, the tank unit out of a pair of tank units 22, 23 in the windward evaporation portion 20, which is arranged on an upper side, is referred to as a first windward tank unit 22 (fourth tank unit), and the tank unit configured to be arranged on the lower side is referred to as a second windward tank unit 23 (second tank unit).

The leeward core portion 11 and the windward core portion 21 of the present embodiment are each formed of a stacked member including multiple tubes 111, 211 extending in an up-down direction (vertical direction), and fins 112 joined between the adjacent tubes 111, 211 arranged so as to be stacked alternately. The stacking direction of the stacked member of the multiple tubes 111, 211 and the multiple fins 112 is referred to as a tube stacking direction, hereinafter. Only a part of the fins 112 is illustrated in FIG. 1 and FIG. 2 to clarify the illustrations. However, the fins 112 are arranged over a substantially entire area between the adjacent tubes 111. Illustration of fins of the windward evaporation portion 20 is omitted in FIG. 1 and FIG. 2 to clarify the illustrations. However, the fins are arranged over a substantially entire area between the adjacent tubes 211 in the windward evaporation portion 20 as well in the same manner as the leeward evaporation portion 10.

Here, the leeward core portion 11 includes a first leeward core portion 11 a including a tube set, which is a part of the multiple tubes 111 and a second leeward core portion 11*b* including a tube set which is a remaining part thereof. The first leeward core portion 11*a* in the present embodiment may be used as an example of a first core portion having a set of the multiple tubes 111. The second leeward core portion 11*b* may be used as an example of a second core portion having a remaining set of the multiple tubes 111.

In the present embodiment, the tube set located on the left side in the tube stacking direction when viewing the leeward core portion 11 from the downstream side of the blast air flow (from a direction indicated by an arrow Y in FIG. 1, FIG. 2, and FIG. 5) constitutes a part of the first leeward core portion 11*a*, and the tube set located on the right side in the tube stacking direction constitutes a part of the second leeward core portion 11*b*.

The windward core portion 21 includes a first windward core portion 21*a* including a tube set, which is a part of the multiple tubes 211 and a second windward core portion 21*b* including a tube set which is a remaining part thereof. The first windward core portion 21*a* of the present embodiment may be used as an example of a third core portion having a set of the multiple tubes 211 opposing at least a part of the first core portion in the flowing direction of the cooling target fluid. The second windward core portion 21*b* may be used as an example of a fourth core portion having a set of the multiple tubes 211 opposing at least a part of the second core portion in the flowing direction of the cooling target fluid.

In the present embodiment, the tube set located on the left side in the tube stacking direction when viewing the windward core portion 21 from the downstream side of the blast air flow constitutes a part of the first windward core portion 21*a*, and the tube set located on the right side in the tube stacking direction constitutes a part of the second windward core portion 21*b*. In the present embodiment, the first leeward core portion 11*a* and the first windward core portion 21*a* are arranged so as to overlap (oppose) each other and the second leeward core portion 11*b* and the second windward core portion 21*b* are arranged so as to overlap (oppose) each other when viewed in the flowing direction of the blast air.

The tubes 111, 211 are each formed of a flat tube provided with a refrigerant flow channel in which the refrigerant flows formed in the interior thereof, and having a flat shape with a cross-sectional shape thereof extending along the flowing direction of the blast air.

The tubes 111 of the leeward core portion 11 are connected at one end side (upper end side) in the longitudinal direction with the first leeward tank unit 12, and are connected at the other end side (lower end side) in the longitudinal direction with the second leeward tank unit 13. The tubes 211 of the windward core portion 21 are connected at one end side (upper end side) in the longitudinal direction with the first windward tank unit 22, and are connected at the other end side (lower end side) in the longitudinal direction with the second windward tank unit 23.

The fins 112 are corrugate fins each formed by bending a thin plate member into a wave shape, are joined to flat outer surfaces of the tubes 111, 211 to constitute a part of heat-exchange promoting means for enlarging a heat transfer surface area for the blast air and the refrigerant.

The stacked member including the tubes 111, 211 and the fins 112 is provided with side plates 113, 213 configured to reinforce the respective core portions 11, 21 at both ends thereof in the tube stacking direction. The side plates 113, 213 are joined to the fins 112 arranged outermost sides in the tube stacking direction.

The first leeward tank unit 12 is formed of a cylindrical member closed at one end side (the right side end when viewed from the downstream side of the blast air flow) and connected at the other end side (the left side end when viewed from the downstream side of the blast air flow) to a refrigerant inflow portion 12*a* for introducing a low pressure refrigerant reduced in pressure by an expansion valve (illustration is omitted). The first leeward tank unit 12 is provided with through holes (illustration is omitted) which allow insertion and joint of one end side (upper end side) of the respective tubes 111 thereto on a bottom portion thereof. In other words, the first leeward tank unit 12 has an internal space configured to communicate with the respective tubes 111 of the leeward core portion 11, and functions as a refrigerant distributing portion configured to distribute the refrigerant to the respective core portions 11*a*, 11*b* of the leeward core portion 11. The refrigerant inflow portion 12*a* may be positioned closer to the first core portion than to the second core portion.

The first windward tank unit 22 is formed of a cylindrical member being closed at one end side thereof and is provided at the other end side with a refrigerant outflow portion 22*a* formed in the interior of the tank for outflowing the refrigerant from the interior of the tank to an intake side of a compressor (illustration is omitted). The first windward tank unit 22 is provided with through holes (illustration is omitted) which allow insertion and joint of one end side (upper end side) of the respective tubes 211 thereto on a bottom portion thereof. In other words, the first windward tank unit 22 has an internal space configured to communicate with the respective tubes 211 of the windward core portion 21, and functions as a refrigerant collecting portion configured to collect the refrigerant to the respective core portions 21*a*, 21*b* of the windward core portion 21.

The second leeward tank unit 13 is formed of a cylindrical member closed at both end sides thereof. The second leeward tank unit 13 is provided with through holes (illustration is omitted) which allow insertion and joint of the other end side (lower end side) of the respective tubes 111 thereto on a ceiling portion thereof. In other words, the second leeward tank unit 13 has an internal space configured to communicate with the respective tubes 111.

Figure 3:
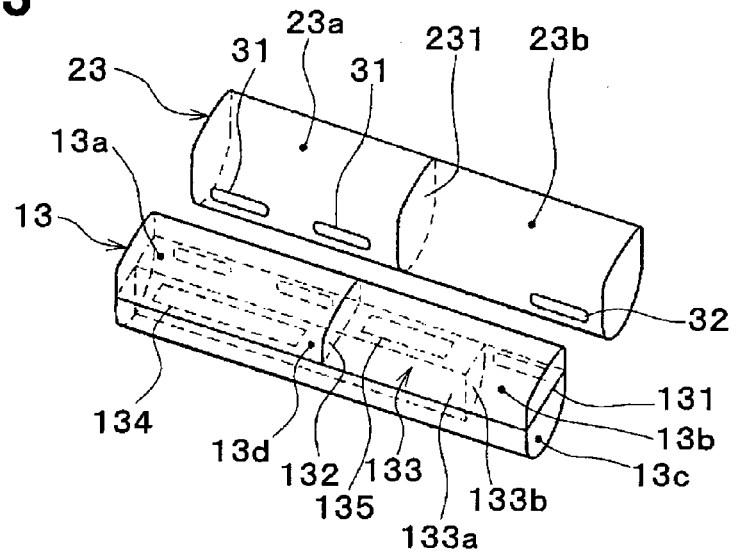
FIG. 3 is a transparent perspective view illustrating a second leeward tank unit and a second windward tank unit according to the first embodiment.
Figure 4:
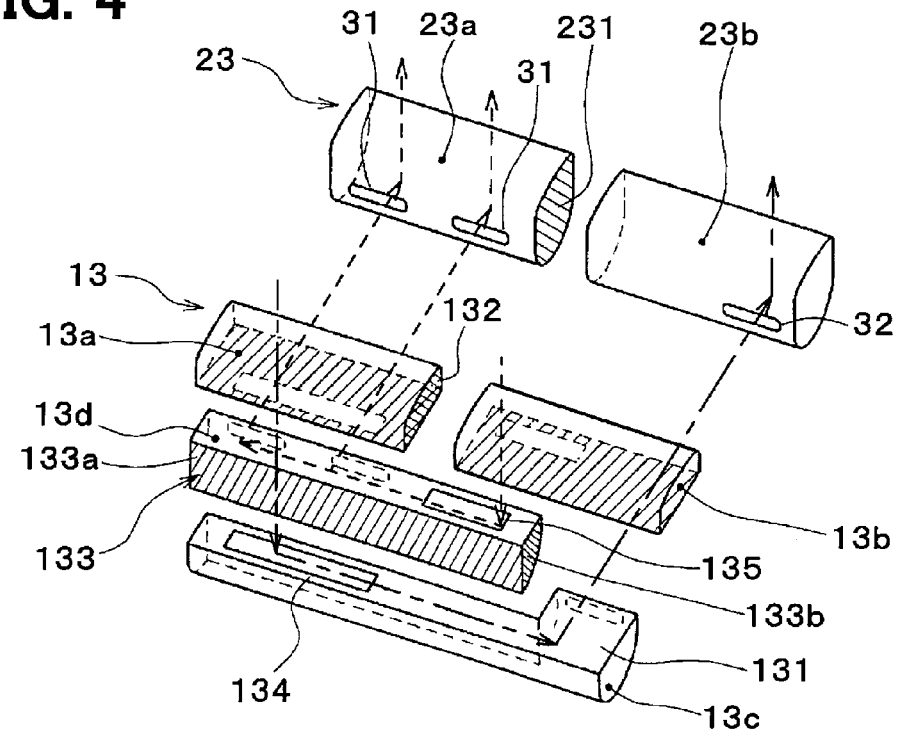
FIG. 4 is an exploded perspective view illustrating the second leeward tank unit and the second windward tank unit according to the first embodiment.

As illustrated in FIG. 3 and FIG. 4, a first partitioning member 131 is arranged at a center position in the up-down direction in the interior of the second leeward tank unit 13, and the first partitioning member 131 partitions the internal space of the tank into an upper space and a lower space. In contrast, a second partitioning member 132 is arranged at a center position in the longitudinal direction (the tube stacking direction) in the interior of the upper space, and the second partitioning member 132 partitions the upper space into a space communicating with the respective tubes 111 which constitute a part of the first leeward core portion 11*a* and a space communicating with the respective tubes 111 which constitute a part of the second leeward core portion 11*b*.

Here, a space communicating with the respective tubes 111 which constitute a part of the first leeward core portion 11*a* in the interior of the upper space of the second leeward tank unit 13 constitutes a part of a first refrigerant collecting portion 13*a* in which the refrigerant from the first leeward core portion 11*a* is collected, and a space communicating with the respective tubes 111 which constitute a part of the second leeward core portion 11*b* constitutes a part of a second refrigerant collecting portion 13*b* in which the refrigerant from the second leeward core portion 11*b* is collected.

A third partitioning member 133 configured to partition a part of the lower space into two parts in the flowing direction of the blast air (fore-and-aft direction) is arranged in the interior of the lower space of the second leeward tank unit 13. The third partitioning member 133 includes two members, namely, a first member 133*a* and a second member 133*b*.

The first member 133*a* is connected at one end side in the longitudinal direction to an end portion of the second leeward tank unit 13 on a side closer to the refrigerant inflow portion 12*a* in the tube stacking direction (the left side of the paper plane), and is formed so as to partition a part of the lower space into two parts in the flowing direction of the blast air. The first member 133*a* is arranged in the lower space at a center position in the flowing direction of the blast air.

The second member 133*b* is connected to an end of the first member 133*a* on the other end side in the longitudinal direction, and extends toward the second windward tank unit 23 (upstream in the blast air flow).

The third partitioning member 133 configured in such a manner partitions the lower space of the second leeward tank unit 13 into a first lower space 13*c* formed into a substantially L-shape when viewed in the longitudinal direction of the tubes 111 (hereinafter, referred to as a longitudinal direction of the tubes (direction of an arrow Z on the paper plane)), and a second lower space 13*d* extending in the tube stacking direction.

The first partitioning member 131 is provided with a first communicating hole 134 configured to communicate the first refrigerant collecting portion 13*a* and the first lower space 13*c* and a second communicating hole 135 configured to communicate the second refrigerant collecting portion 13*b* and the second lower space 13*d*. More specifically, the first communicating hole 134 is arranged on the downstream side of the blast air flow of the first partitioning member 131, and on the side closer to the refrigerant inflow portion 12*a* in the tube stacking direction. The second communicating hole 135 is arranged on the upstream side of the blast air flow of the first partitioning member 131, and on a portion biased from the center portion rather away from the refrigerant inflow portion 12*a* in the tube stacking direction.

The second windward tank unit 23 is formed of a cylindrical member closed at both end sides thereof. The second windward tank unit 23 is provided with through holes (illustration is omitted) which allow insertion and joint of the other end side (lower end side) of the respective tubes 211 thereto on a ceiling portion thereof. In other words, the second windward tank unit 23 has an internal space configured to communicate with the respective tubes 211.

A partitioning portion 231 is arranged in the interior of the second windward tank unit 23 at a center position in the longitudinal direction thereof, and the partitioning portion 231 partitions the internal space of the tank into a space communicating with the respective tubes 211 which constitute a part of the first windward core portion 21*a* and a space communicating with the respective tubes 211 which constitute a part of the second windward core portion 21*b*.

Here, in the interior of the second windward tank unit 23, a space communicating with the respective tubes 211 which constitute a part of the first windward core portion 21*a* constitutes a first refrigerant distributing portion 23*a* configured to distribute the refrigerant to the first windward core portion 21*a*, and a space communicating with the respective tubes 211 which constitute a part of the second windward core portion 21*b* constitutes a second refrigerant distributing portion 23*b* configured to distribute the refrigerant to the second windward core portion 21*b*.

The second lower space 13*d* of the second leeward tank unit 13 and the first refrigerant distributing portion 23*a* of the second windward tank unit 23 are connected through first communicating portions 31. The first lower space 13*c* of the second leeward tank unit 13 and the second refrigerant distributing portion 23*b* of the second windward tank unit 23 are connected through a second communicating portion 32.

In the present embodiment, the first communicating portions 31 extend in the tube stacking direction, and two each of the first communicating portions 31 are arranged on the second leeward tank unit 13 and the second windward tank unit 23 in regions closer to the refrigerant inflow portion 12*a* in the tube stacking direction. The second communicating portion 32 extends in the tube stacking direction, and the number of the second communicating portion 32 is one. The second communicating portion 32 is arranged to be adjacent to end portions of the second leeward tank unit 13 and the second windward tank unit 23 that are distal from the refrigerant inflow portion 12*a* in the tube stacking direction.

Here, the refrigerant flow in the second leeward tank unit 13 and the second windward tank unit 23 will be described. As illustrated by an arrow of alternate chain line in FIG. 4, the refrigerant flowed out from the respective tubes 111 which constitute a part of the first leeward core portion 11*a* is collected to the first refrigerant collecting portion 13*a* of the second leeward tank unit 13, and then flowed into the first lower space 13*c* via the first communicating hole 134. The refrigerant flowed into the first lower space 13*c* flows in the first lower space 13*c* from near the refrigerant inflow portion 12*a* to farther therefrom in the tube stacking direction, and flows into the second refrigerant distributing portion 23*b* of the second windward tank unit 23 via the second communicating portion 32. The refrigerant flowed into the second refrigerant distributing portion 23*b* is distributed to the respective tubes 211 which constitute a part of the second windward core portion 21*b*.

In contrast, as illustrated by a broken arrow in FIG. 4, the refrigerant flowed out from the respective tubes 111 which constitute a part of the second leeward core portion 11*b* is collected to the second refrigerant collecting portion 13*b* of the second leeward tank unit 13, and then flowed into the second lower space 13*d* via the second communicating hole 135. The refrigerant flowed into the second lower space 13*d* flows in the second lower space 13*d* from afar to near the refrigerant inflow portion 12*a* in the tube stacking direction, and flows into the first refrigerant distributing portion 23*a* of the second windward tank unit 23 via the first communicating portions 31. The refrigerant flowed into the first refrigerant distributing portion 23*a* is distributed into the respective tubes 211 which constitute a part of the first windward core portion 21*a*.

Therefore, when the refrigerant flows through the lower spaces 13*c*, 13*d* of the second leeward tank unit 13, the refrigerant flow is switched in the core portions 11, 21 in the tube stacking direction (in the width direction of the core portions 11, 21). Therefore, the lower spaces 13*c*, 13*d* of the second leeward tank unit 13 of the present embodiment may be provided as an example of a refrigerant flow changing portion that guides the refrigerant in the first refrigerant collecting portion 13*a* into the second refrigerant distributing portion 23*b*, and guides the refrigerant in the second refrigerant collecting portion 13*b* to the first refrigerant distributing portion 23*a*.

Also, the refrigerant flows in the first lower space 13*c* of the second leeward tank unit 13 from near the refrigerant inflow portion 12*a* toward farther therefrom in the tube stacking direction, and the refrigerant flows in the second lower space 13*d* of the second leeward tank unit 13 from afar to near the refrigerant inflow portion 12*a* in the tube stacking direction. In other words, the refrigerant flow in the first lower space 13*c* and the refrigerant flow in the second lower space 13*d* oppose to each other.

Therefore, in the refrigerant flow changing portion, that is, in the lower spaces 13*c*, 13*d* of the second leeward tank unit 13, the refrigerant flow from the first refrigerant collecting portion 13*a* to the second refrigerant distributing portion 23*b*, and the refrigerant flow from the second refrigerant collecting portion 13*b* to the first refrigerant distributing portion 23*a* are in a non-crossed state when viewed from the longitudinal direction of the tube.

In the present embodiment, the first leeward tank unit 12 and the first windward tank unit 22 are formed integrally, and the second leeward tank unit 13 and the second windward tank unit 23 are formed integrally. Hereinafter, an integrated structure of the first leeward tank unit 12 and the first windward tank unit 22 is referred to as a first header tank 51, and an integrated structure of the second leeward tank unit 13 and the second windward tank unit 23 is referred to as a second header tank 52.

The header tanks 51, 52 include header plates 511, 521 to which both the tubes 111, 211 arranged in two rows in the flowing direction of the blast air are fixed, and tank forming members 512, 522, respectively. The tank forming members 512, 522 are fixed to the header plates 511, 521, so that spaces for allowing the refrigerant to flow therethrough are formed therein. Specifically, the tank forming members 512, 522 are formed into a double-mountain shape (W-shape) when viewed from the longitudinal direction thereof by applying press work on a flat metal plate.

The center portion of the double-mountain shape of the tank forming member 512 is joined to the header plate 511, so that the first leeward tank unit 12 and the first windward tank unit 22 are partitioned. The center portion of the double-mountain shape of the tank forming member 522 is joined to the header plate 521, so that the second leeward tank unit 13 and the second windward tank unit 23 are partitioned. A gap is formed partly between the center portion of the double-mountain shape of the tank forming member 522 and the header plate 521, so that the first communicating portions 31 and the second communicating portion 32 are formed.

As described thus far, the lower spaces 13*c*, 13*d* of the second leeward tank unit 13 are configured to guide the refrigerant in the first refrigerant collecting portion 13*a* into the second refrigerant distributing portion 23*b*, and guide the refrigerant in the second refrigerant collecting portion 13*b* to the first refrigerant distributing portion 23*a*, so that the flowing direction of the refrigerant may be switched in the width direction of the core portions 11, 21 (in the tube stacking direction) in the second leeward tank unit 13. At this time, provision of a separate member other than the second leeward tank unit 13 is not necessary in order to switch the flowing direction of the refrigerant. Therefore, the flowing direction of the refrigerant may be switched in the width direction of the core portions 11, 21 while restricting the increase in the refrigerant sealing amount.

Furthermore, in the present embodiment, the refrigerant flow changing portion, that is, the lower spaces 13*c*, 13*d* of the second leeward tank unit 13 are configured in such a manner that the flow of the refrigerant from the first refrigerant collecting portion 13*a* to the second refrigerant distributing portion 23*b*, and the flow of the refrigerant from the second refrigerant collecting portion 13*b* to the first refrigerant distributing portion 23*a* are not crossed to each other when viewed from the longitudinal direction of the tube. Accordingly, arrangement of the intersecting communicating portion between the adjacent tubes 111, 211 is not necessary, so that an increase in a pressure loss of the refrigerant generating when the flowing direction of the refrigerant is switched in the width direction of the core portions 11, 21 can be restricted. Therefore, the capacity to cool the blast air in the refrigerant evaporator 1 can be improved.

Figure 5:
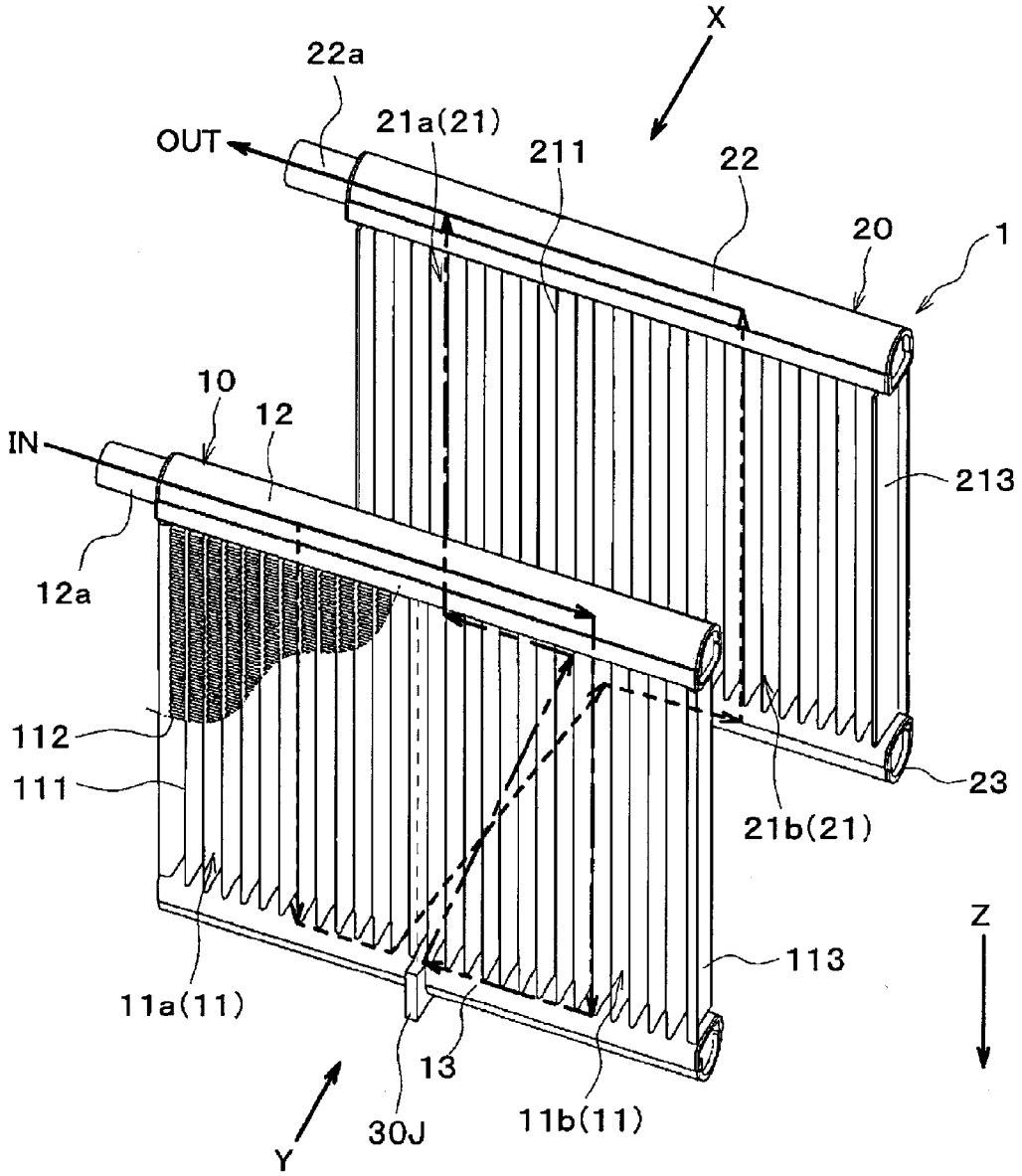
FIG. 5 is a schematic exploded perspective view illustrating a refrigerant evaporator according to a comparative example.

Here, a refrigerant evaporator of a comparative example is illustrated in FIG. 5. The refrigerant evaporator 1 of the comparative example includes an intersecting communicating portion 30J configured to cause the refrigerant after the passage through the leeward core portion 11 to intersect before flowing into the windward core portion leftward and rightward (in the width direction of the core portion, or in the tube stacking direction) provided at a center portion of the second leeward tank unit 13 in the left-and-right direction. An arrow of a dashed line and an arrow of a broken line in FIG. 5 indicate the flow of the refrigerant.

Figure 6:
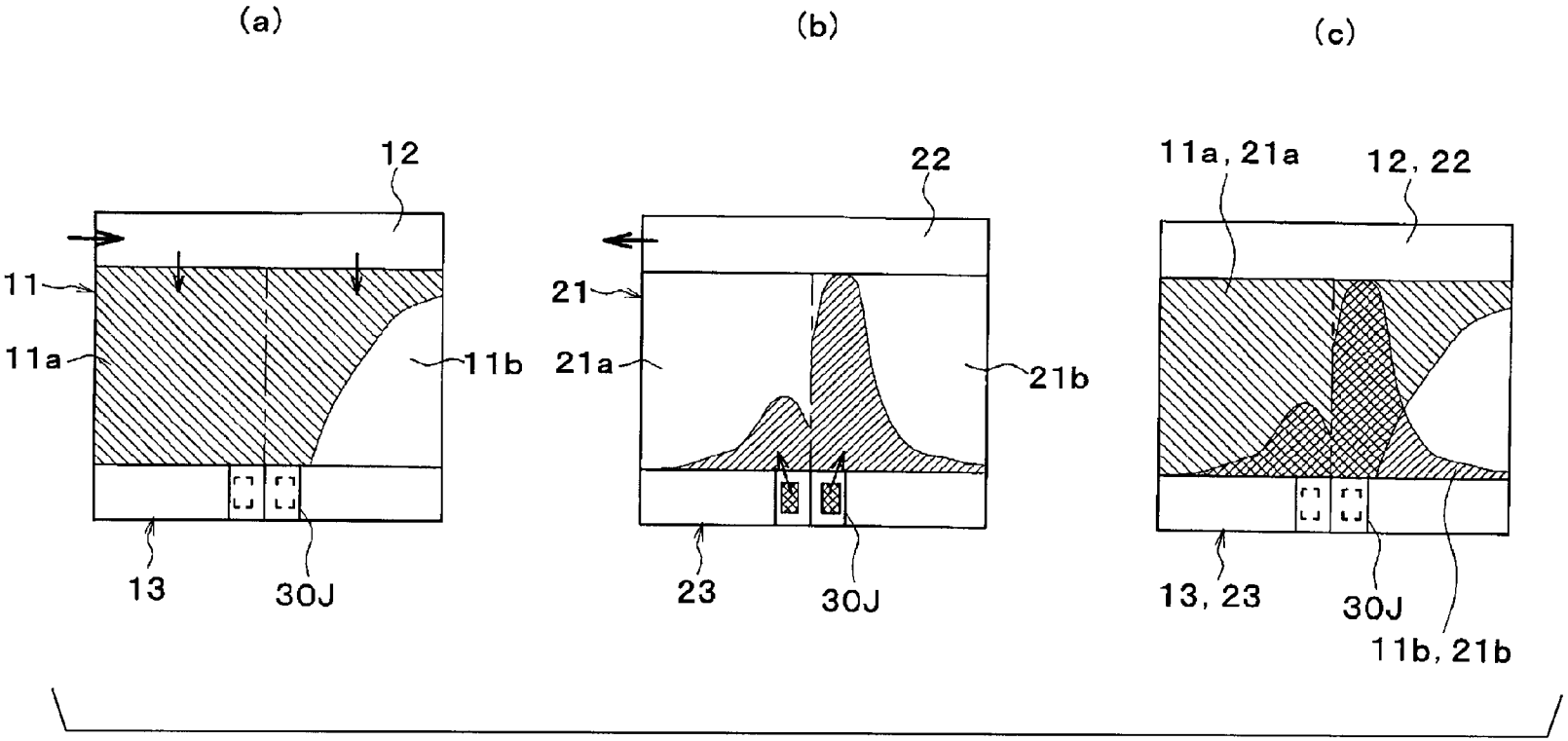
FIG. 6 is diagrams for explaining a distribution of a liquid-phase refrigerant flowing in respective core portions of the refrigerant evaporator according to the comparative example.
Figure 7:
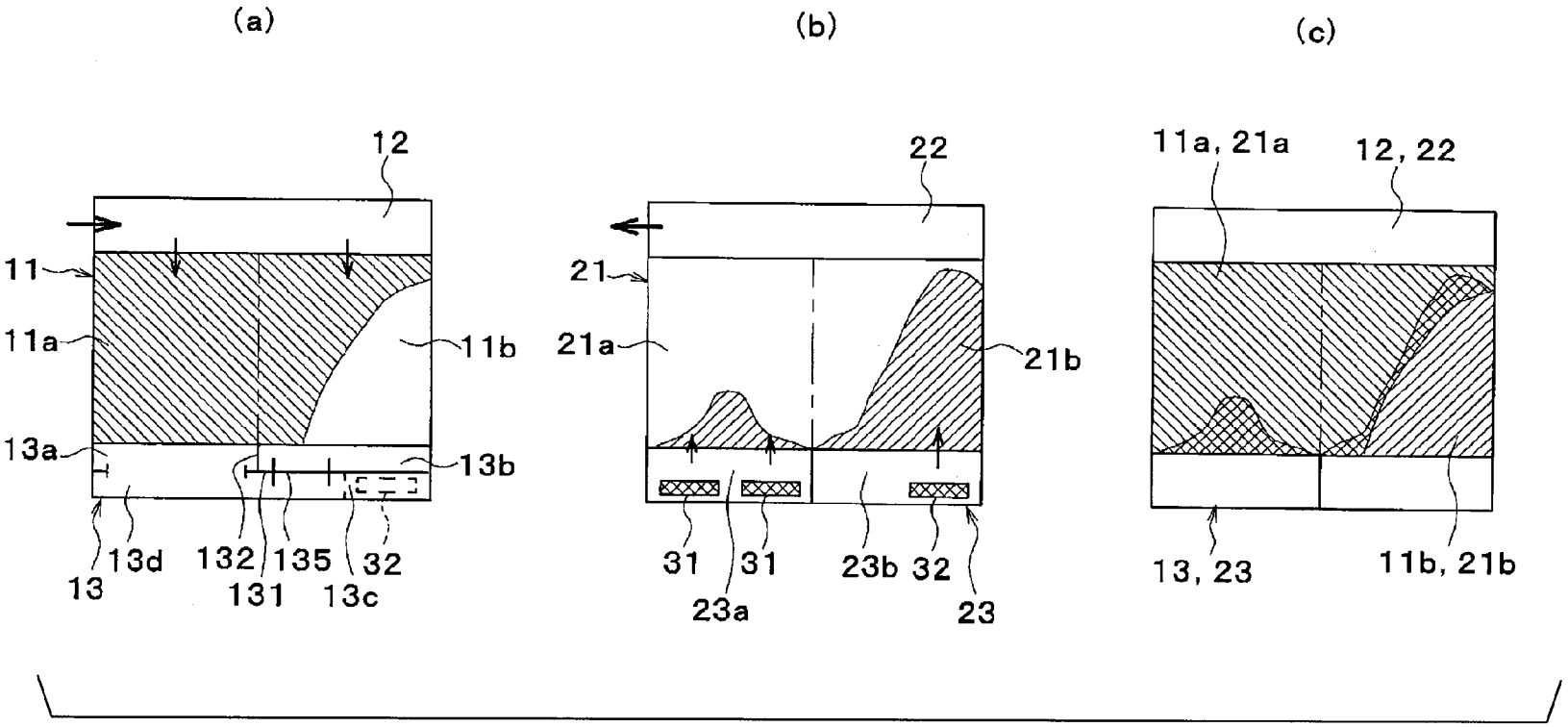
FIG. 7 is diagrams for explaining a distribution of a liquid-phase refrigerant flowing in respective core portions of the refrigerant evaporator according to the first embodiment.
Figure 8:
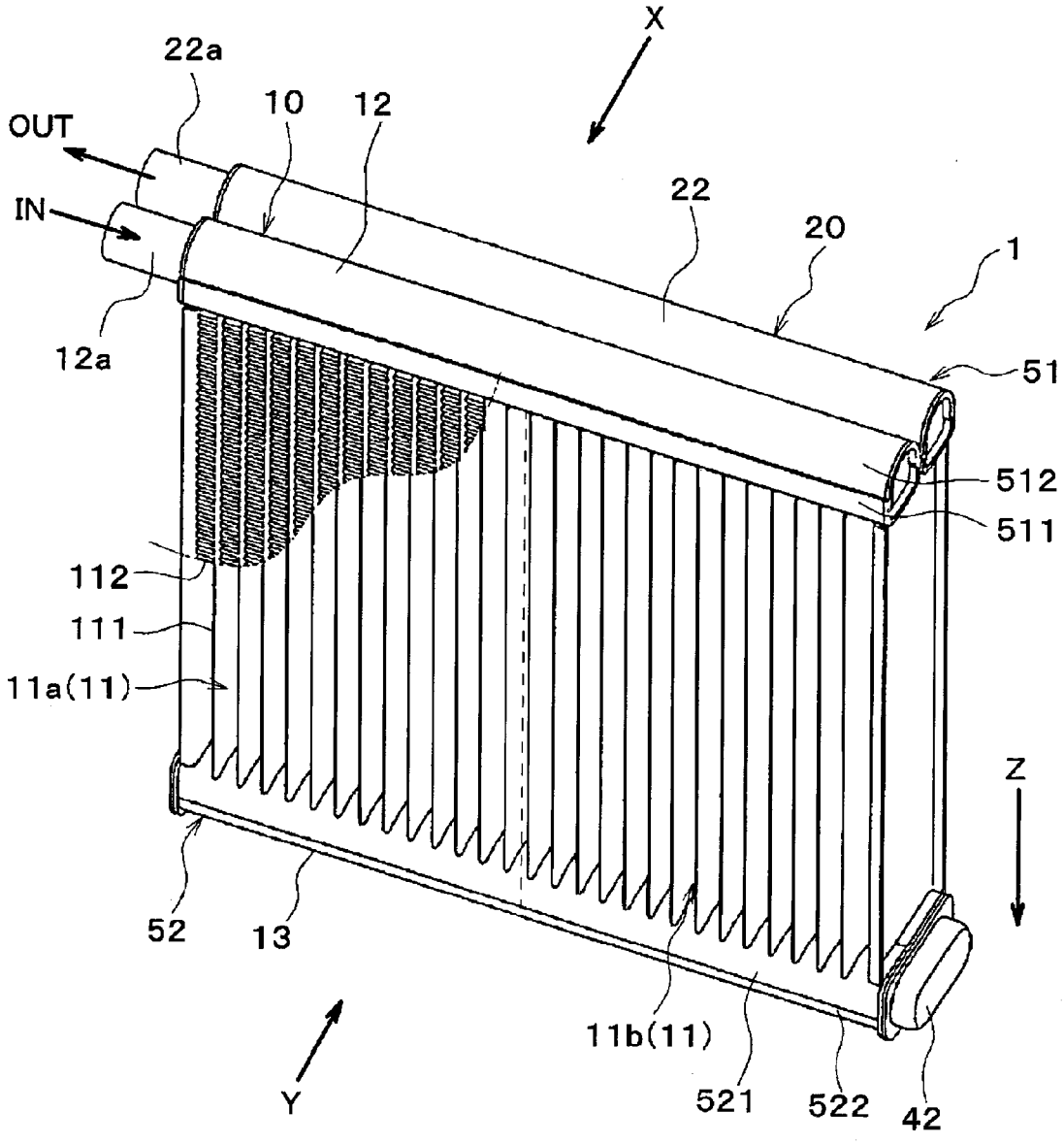
FIG. 8 is a schematic perspective view illustrating a refrigerant evaporator according to a second embodiment of the present disclosure.
Figure 9:
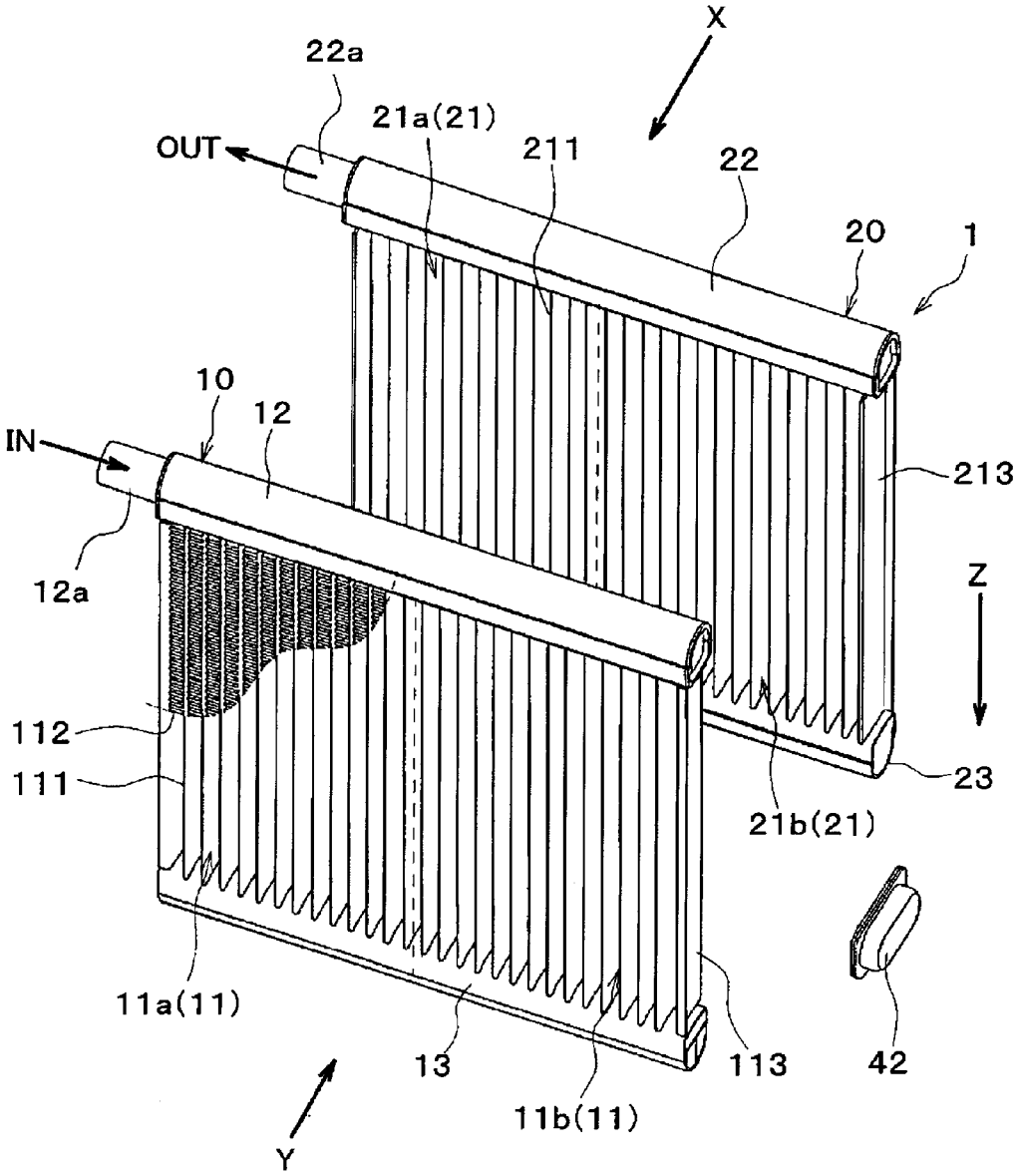
FIG. 9 is an exploded perspective view illustrating the refrigerant evaporator according to the second embodiment.
Figure 10:
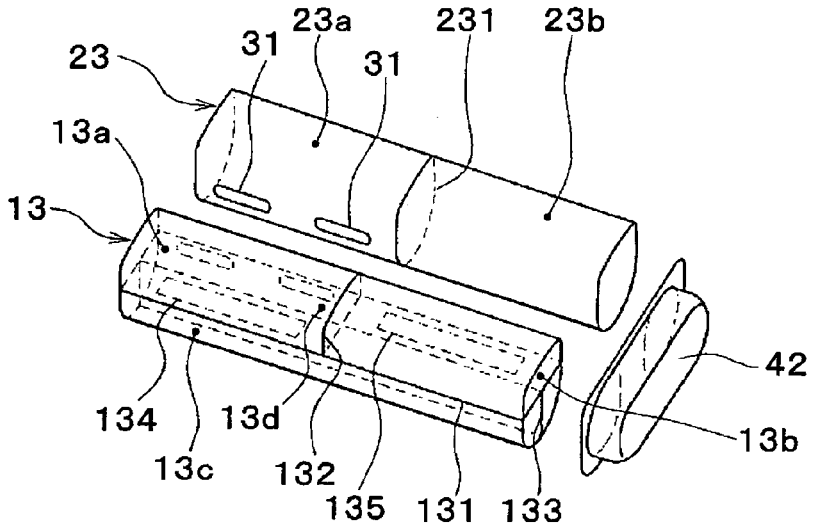
FIG. 10 is a transparent perspective view illustrating a second leeward tank unit and a second windward tank unit according to the second embodiment.
Figure 11:
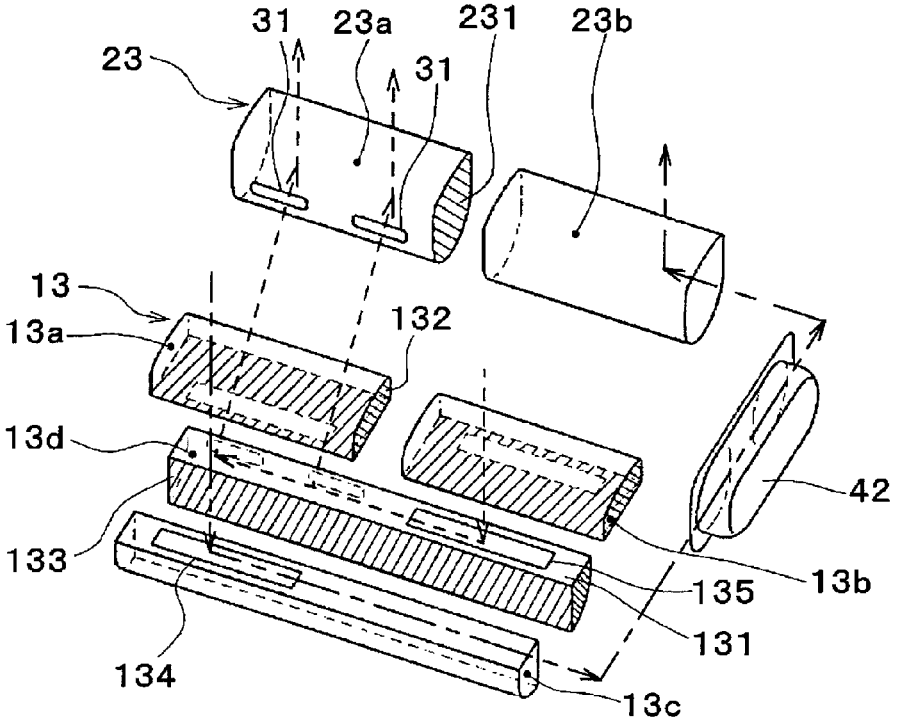
FIG. 11 is an exploded perspective view illustrating the second leeward tank unit and the second windward tank unit according to the second embodiment.
Figure 12:
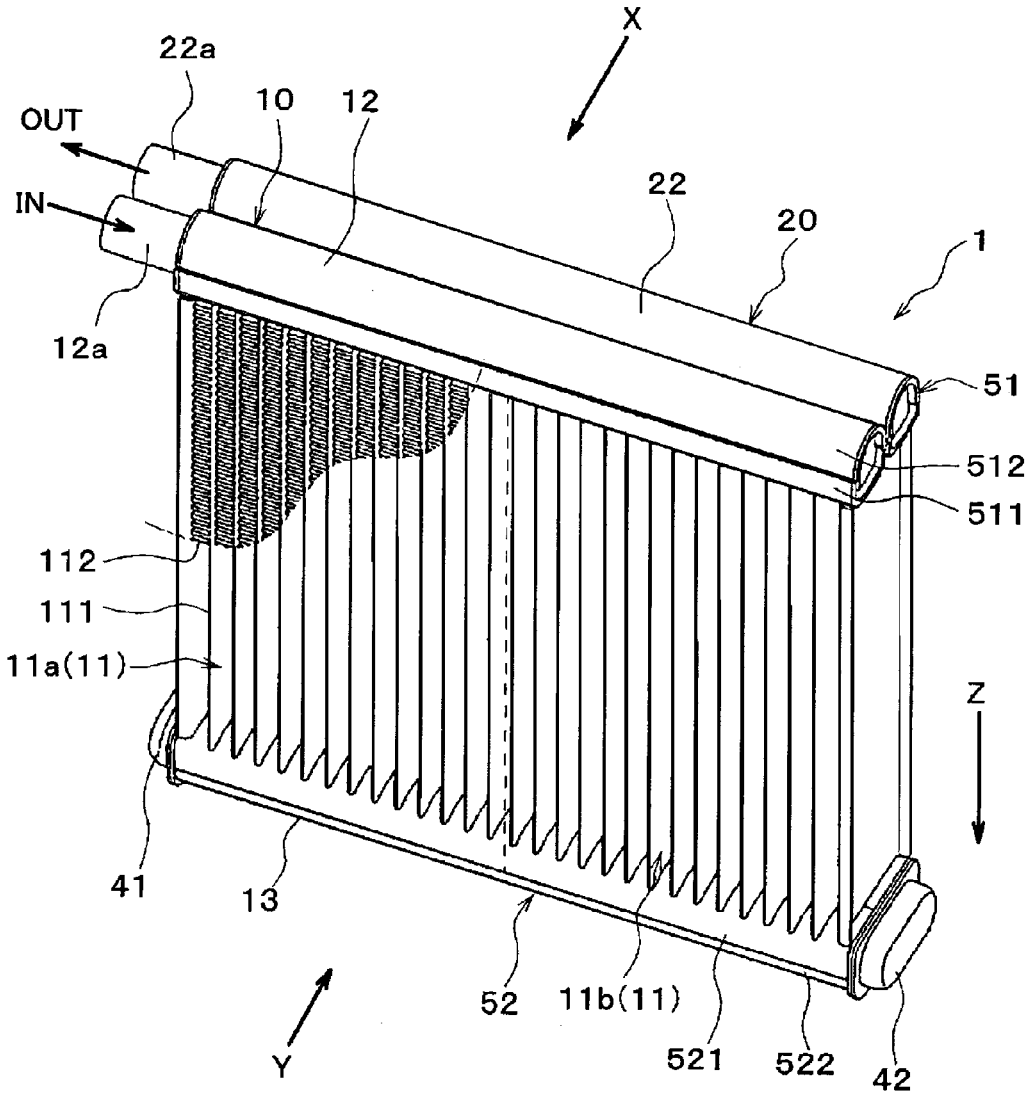
FIG. 12 is a schematic perspective view illustrating a refrigerant evaporator according to a third embodiment of the present disclosure.
Figure 13:
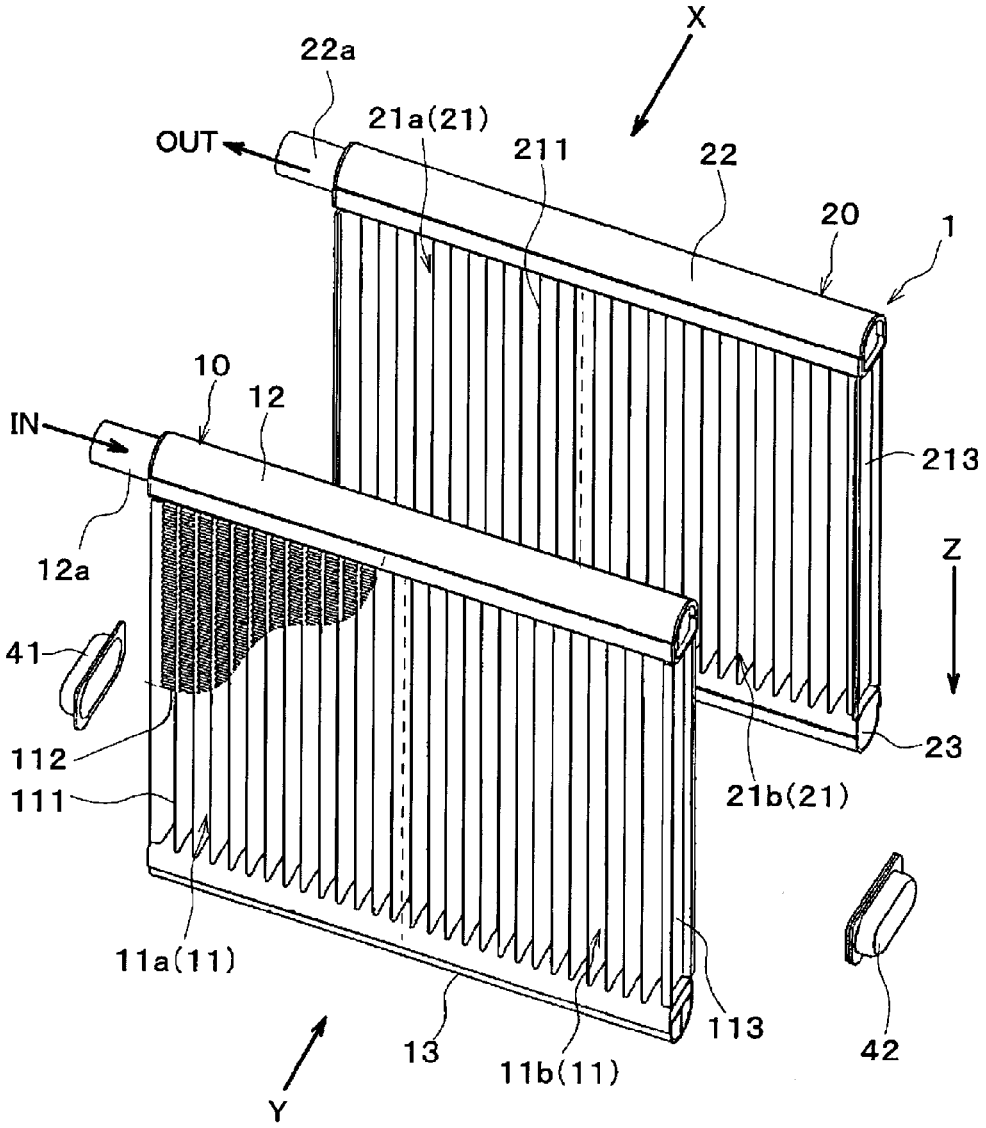
FIG. 13 is an exploded perspective view illustrating the refrigerant evaporator according to the third embodiment.
Figure 14:
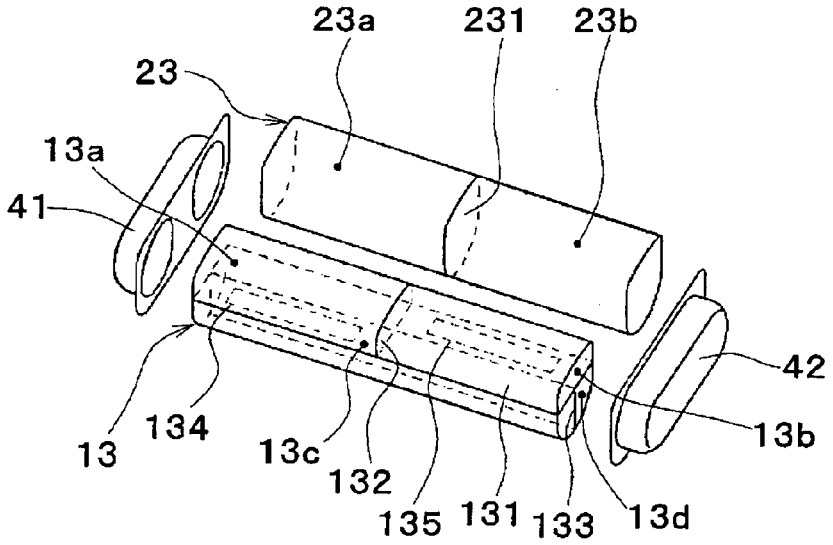
FIG. 14 is a transparent perspective view illustrating a second leeward tank unit and a second windward tank unit according to the third embodiment.
Figure 15:
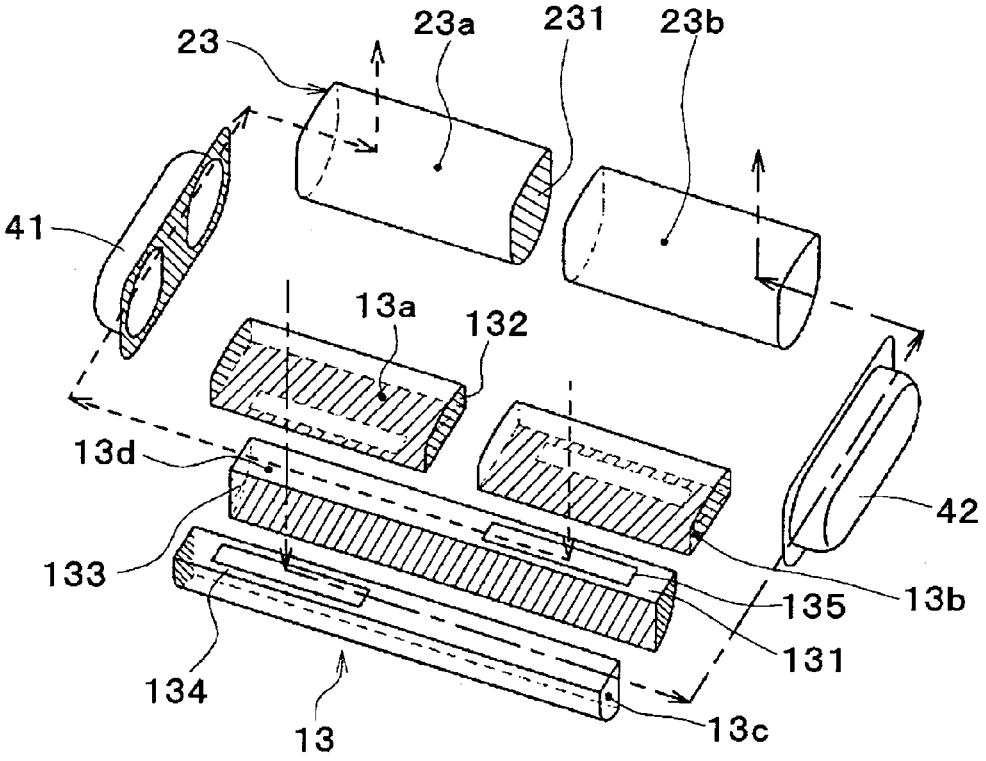
FIG. 15 is an exploded perspective view illustrating the second leeward tank unit and the second windward tank unit according to the third embodiment.

A distribution of the liquid-phase refrigerant flowing in the respective core portions 11, 21 of the refrigerant evaporator 1 of the comparative example is illustrated in FIG. 6, and a distribution of the liquid-phase refrigerant flowing in the respective core portions 11, 21 of the refrigerant evaporator 1 of the first embodiment is illustrated in FIG. 7. FIG. 6(*a*) and FIG. 7(*a*) each illustrate a distribution of the liquid-phase refrigerant flowing in the leeward core portion 11, FIG. 6(*b*) and FIG. 7(*b*) each illustrate a distribution of the liquid-phase refrigerant flowing in the windward core portion 21, and FIG. 6(*c*) and FIG. 7(*c*) each illustrate a synthetic distribution of the liquid-phase refrigerant flowing in the respective core portions 11, 21. FIG. 6 and FIG. 7 each illustrate a distribution of the liquid-phase refrigerant when viewing the refrigerant evaporator 1 in the direction indicated by an arrow Y in FIG. 1 (from the reverse direction of the flowing direction X of the blast air), and hatched portions in the drawings indicate portions where the liquid-phase refrigerant exists.

The distribution of the liquid-phase refrigerant flowing in the leeward core portion 11 of the refrigerant evaporator 1 of the comparative example is the same as the refrigerant evaporator 1 of the present embodiment as illustrated in FIG. 6(*a*) and FIG. 7(*a*), and a position where the liquid-phase refrigerant can hardly flow (a hollow portion on the lower right side in the drawings) is generated in an area that is relatively far from the refrigerant inflow portion 12*a* in the second leeward core portion 11*b*.

In contrast, as regards the distribution of the liquid-phase refrigerant flowing in the windward core portion 21 of the refrigerant evaporator 1 of the comparative example, in the respective core portions 21*a*, 21*b* of the windward core portion 21, the liquid-phase refrigerant can easily flow in a portion where the intersecting communicating portion 30J is formed (center portion) in the tube stacking direction, and the liquid-phase refrigerant can hardly flow in portions where the intersecting communicating portion 30J is not formed (both end portions) as illustrated in FIG. 6(*b*).

As illustrated in FIG. 6(*c*), a position where the liquid-phase refrigerant can hardly flow (the hollow portion on the right side of the drawing) is generated in a part of an overlapping portion between the second leeward core portion 11*b* and the second windward core portion 21*b* when the refrigerant evaporator 1 of the comparative example is viewed in the flowing direction X of the blast air, in other words, the position where the liquid-phase refrigerant can hardly flow is generated in the vicinity of an end portion that is distal from the refrigerant inflow portion 12*a* in the tube stacking direction.

In the refrigerant evaporator 1 of the comparative example in which the liquid-phase refrigerant is distributed in this manner, since the calorific power corresponding to the sensible heat of the refrigerant is absorbed from the blast air at the position where the liquid-phase refrigerant can hardly flow, the blast air cannot be cooled sufficiently. Consequently, generation of an unbalanced temperature distribution in the blast air passing through the refrigerant evaporator 1 may result.

In contrast, as regards the distribution of the liquid-phase refrigerant flowing in the windward core portion 21 of the refrigerant evaporator 1 of the present embodiment, the second communicating portion 32 is connected to the end portion of the second windward tank unit 23 that is distal from the refrigerant inflow portion 12*a* in the tube stacking direction. Thus, as illustrated in FIG. 7(*b*), the liquid-phase refrigerant is capable of flowing easily to a portion adjacent to the end portion that is distal from the refrigerant inflow portion 12*a* in the windward core portion 21 in the tube stacking direction.

As illustrated in FIG. 7(*c*), when the refrigerant evaporator 1 of the present embodiment is viewed in the flowing direction X of the blast air, the liquid-phase refrigerant flows over the entire area of the portion where the second leeward core portion 11*b* and the second windward core portion 21*b* overlap. In this manner, in the refrigerant evaporator 1 of the present embodiment in which the liquid-phase refrigerant is distributed, the calorific power corresponding to an evaporative latent heat of the refrigerant is absorbed from the blast air by any one of the core portions 11, 21, and hence the blast air can be cooled sufficiently. Consequently, generation of an unbalanced temperature distribution in the blast air passing through the refrigerant evaporator 1 is restricted.

In other words, the portion of the windward core portion 21, in which the liquid-phase refrigerant can easily flow, and the portion of the leeward core portion 11, in which the liquid-phase refrigerant can hardly flow, oppose each other, that is, overlap with each other when viewed in the flowing direction X of the blast air, generation of the unbalanced temperature distribution in the blast air passing through the refrigerant evaporator 1 can be restricted in the refrigerant evaporator 1 as a whole.

(Second Embodiment)

Subsequently, a second embodiment of the present disclosure will be described with reference to FIG. 8 to FIG. 11. The second embodiment is different from the first embodiment described above in configuration of a communicating portion between a first lower space 13*c* of a second leeward tank unit 13 and a second refrigerant distributing portion 23*b* of a second windward tank unit 23.

A third partitioning member 133 of the present embodiment is connected to an inner wall surface of the second leeward tank unit 13 at both end portions in a longitudinal direction (tube stacking direction). With the third partitioning member 133 configured in this manner, the entire area of a lower space of the second leeward tank unit 13 is partitioned into two parts, namely, the first lower space 13*c* and a second lower space 13*d* in the flowing direction of a blast air. The first lower space 13*c* is arranged on the downstream side of the blast air flow with respect to the second lower space 13*d*. The third partitioning member 133 is arranged in the lower space at a center position in the flowing direction of the blast air.

The second leeward tank unit 13 and the second windward tank unit 23 are coupled by a joint 42. The joint 42 is connected to respective end portions of the second leeward tank unit 13 and the second windward tank unit 23 that are distal from a refrigerant inflow portion 12*a* in the tube stacking direction.

The refrigerant flow channel in which a refrigerant flows is formed in an interior of the joint 42. The first lower space 13*c* of the second leeward tank unit 13 and the second refrigerant distributing portion 23*b* of the second windward tank unit 23 are connected through the refrigerant flow channel in the interior of the joint 42. Therefore, the joint 42 of the present embodiment may be used as an example of a second communicating portion.

Here, as regards the refrigerant flow in the second leeward tank unit 13 and the second windward tank unit 23, only portions different from the above-described first embodiment will be described. As illustrated by an arrow of alternate chain line in FIG. 11, the refrigerant flowed out from respective tubes 111 which constitute a part of a first leeward core portion 11*a* is collected to a first refrigerant collecting portion 13*a* of the second leeward tank unit 13, and then flowed into the first lower space 13*c* via a first communicating hole 134. The refrigerant flowed into the first lower space 13*c* flows in the first lower space 13*c* from near the refrigerant inflow portion 12*a* to farther therefrom in the tube stacking direction, and flows into the second refrigerant distributing portion 23*b* of the second windward tank unit 23 via the refrigerant flow channel in the interior of the joint 42. The refrigerant flowed into the second refrigerant distributing portion 23*b* is distributed to respective tubes 211 which constitute a part of a second windward core portion 21*b*.

As described above, with the configuration of the second embodiment as well, the same advantages as those in the first embodiment can be obtained.

(Third Embodiment)

Subsequently, a third embodiment of the present disclosure will be described with reference to FIG. 12 to FIG. 15. The third embodiment is different from the second embodiment described above in configuration of a communicating portion between a second lower space 13*d* of a second leeward tank unit 13 and a first refrigerant distributing portion 23*a* of a second windward tank unit 23.

The second leeward tank unit 13 and the second windward tank unit 23 of the present embodiment are coupled by a first joint 41 and a second joint 42. The first joint 41 is connected to respective ends of the second leeward tank unit 13 and the second windward tank unit 23, on a side closer to a refrigerant inflow portion 12*a* in a tube stacking direction. The second joint 42 is connected to respective end portions of the second leeward tank unit 13 and the second windward tank unit 23 that are distal from the refrigerant inflow portion 12*a* in the tube stacking direction.

Refrigerant flow channels in which a refrigerant flows are formed in interiors of the first joint 41 and the second joint 42, respectively. The second lower space 13*d* of the second leeward tank unit 13 and the first refrigerant distributing portion 23*a* of the second windward tank unit 23 are connected through the refrigerant flow channel in the interior of the first joint 41. A first lower space 13*c* of the second leeward tank unit 13 and a second refrigerant distributing portion 23*b* of the second windward tank unit 23 are connected through the refrigerant flow channel in the interior of the second joint 42. Therefore, the first joint 41 of the present embodiment may be used as an example of a first communicating portion, and the second joint 42 of the present embodiment may be used as an example of a second communicating portion.

Here, as regards the refrigerant flow in the second leeward tank unit 13 and the second windward tank unit 23, only portions different from the above-described second embodiment will be described. As illustrated by a broken arrow in FIG. 15, the refrigerant flowed out from respective tubes 111 which constitute a part of a second leeward core portion 11*b* is collected to a second refrigerant collecting portion 13*b* of the second leeward tank unit 13, and then flowed into the second lower space 13*d* via a second communicating hole 135. The refrigerant flowed into the second lower space 13*d* flows in the second lower space 13*d* from afar to near the refrigerant inflow portion 12*a* in the tube stacking direction, and flows into the first refrigerant distributing portion 23*a* of the second windward tank unit 23 via the refrigerant flow channel in the interior of the first joint 41. The refrigerant flowed into the first refrigerant distributing portion 23*a* is distributed into respective tubes 211 which constitute a part of a first windward core portion 21*a*.

As described above, with the configuration of the third embodiment as well, the same advantages as those in the second embodiment can be obtained.

(Fourth Embodiment)

Subsequently, a fourth embodiment of the present disclosure will be described with reference to FIG. 16 to FIG. 18. The fourth embodiment is different from the first embodiment described above in configuration of a second leeward tank unit 13 and a second windward tank unit 23.

Figure 16:
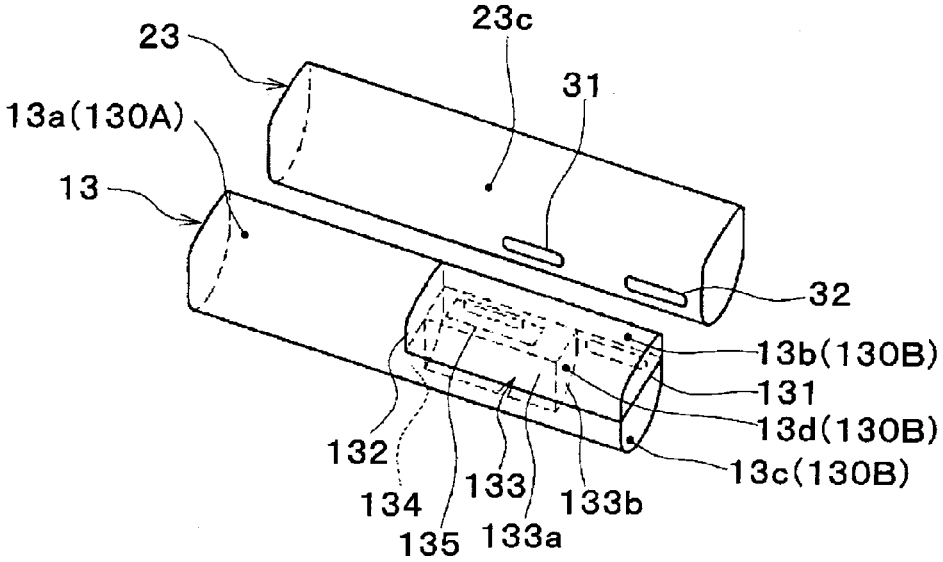
FIG. 16 is a transparent perspective view illustrating a second leeward tank unit and a second windward tank unit according to a fourth embodiment of the present disclosure.
Figure 17:
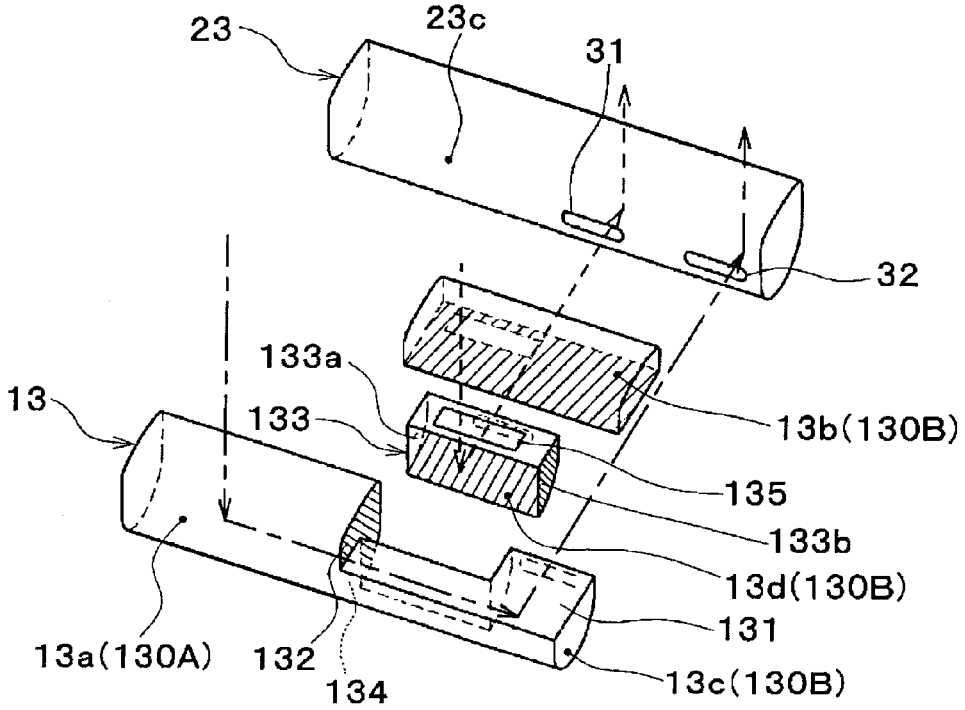
FIG. 17 is an exploded perspective view illustrating the second leeward tank unit and the second windward tank unit according to the fourth embodiment.

As illustrated in FIG. 16 and FIG. 17, a second partitioning member 132 configured to partition an internal space of a tank into two parts, namely a first space 130A and a second space 130B in a tube stacking direction is arranged in an interior of the second leeward tank unit 13 at a substantially center position in the tube stacking direction. The first space 130A is arranged at a portion corresponding to a first leeward core portion 11*a* (left side on the paper plane), and the second space 130B is arranged at a portion corresponding to a second leeward core portion 11*b* (right side on the paper plane).

A first partitioning member 131 is arranged in the second space 130B at a substantially center position in an up-down direction, and the first partitioning member 131 partitions the second space 130B into an upper space and a lower space.

The first space 130A out of the internal space of the tank partitioned by the first partitioning member 131 and the second partitioning member 132 constitutes a space communicating with respective tubes 111 which constitute the first leeward core portion 11*a*, and the upper space of the second space 130B constitutes the space communicating with the respective tubes 111 which constitute the second leeward core portion 11*b*.

Here, a space communicating with the respective tubes 111 which constitute a part of the first leeward core portion 11*a* in the internal space of the second leeward tank unit 13 (that is, the first space 130A) constitutes a part of a first refrigerant collecting portion 13*a* in which a refrigerant from the first leeward core portion 11*a* is collected, and a space communicating with the respective tubes 111 which constitute a part of the second leeward core portion 11*b* (that is, the upper space of the second space 130B) constitutes a part of a second refrigerant collecting portion 13*b* in which the refrigerant from the second leeward core portion 11*b* is collected.

A third partitioning member 133 configured to partition a part of the lower space into two parts in a flowing direction of a blast air (fore-and-aft direction) is arranged in the interior of the lower space in the second space 130B of the second leeward tank unit 13. The third partitioning member 133 includes two members, namely, a first member 133*a* and a second member 133*b*.

The first member 133*a* is formed to be connected at one end side in a longitudinal direction to the second partitioning member 132, and partitions a part of the lower space into two parts in the flowing direction of the blast air. The first member 133*a* is arranged in the lower space at a center position in the flowing direction of the blast air.

The second member 133*b* is connected to an end of the first member 133*a* on the other end side in the longitudinal direction, and extends toward the second windward tank unit 23 (upstream in the blast air flow).

The third partitioning member 133 configured in such a manner partitions the lower space in the second space 130B of the second leeward tank unit 13 into a first lower space 13*c* formed into a substantially L-shape when viewed in a longitudinal direction Z of tubes, and a second lower space 13*d* extending in the tube stacking direction.

The second partitioning member 132 is provided with a first communicating hole 134 formed so as to communicate the first refrigerant collecting portion 13*a* and the first lower space 13*c*. The first partitioning member 131 is provided with a second communicating hole 135 formed so as to communicate the second refrigerant collecting portion 13*b* and the second lower space 13*d*. More specifically, the first communicating hole 134 is arranged on a downstream side of the blast air flow and a lower side in the second partitioning member 132. The second communicating hole 135 is arranged on the upstream side of the blast air flow of the first partitioning member 131, and on a portion biased from the center portion rather away from the refrigerant inflow portion 12*a* in the tube stacking direction.

In the present embodiment, a partitioning portion 231 is not arranged in the interior of the second windward tank unit 23. Therefore, the interior of the second windward tank unit 23 constitutes a refrigerant distributing portion 23*c* configured to distribute the refrigerant to both a first windward core portion 21*a* and a second windward core portion 21*b*.

The second windward tank unit 23 is connected to first communicating portions 31 which allow the refrigerant to flow into the second windward tank unit 23 from the second refrigerant collecting portion 13*b* and a second communicating portion 32 configured to allow the refrigerant to flow into the second windward tank unit 23 from the first refrigerant collecting portion 13*a*. The first communicating portions 31 and the second communicating portion 32 are respectively arranged on the second windward tank unit 23 at portions corresponding to tubes 211 which belong the second windward core portion 21*b* (the right side of the paper plane). The first communicating portions 31 are arranged to be closer to the first windward core portion 21*a* (closer to the refrigerant inflow portion 12*a*) in the tube stacking direction than the second communicating portion 32 is to the first windward core portion 21*a*.

Here, the refrigerant flow in the second leeward tank unit 13 and the second windward tank unit 23 will be described. As illustrated by an arrow of alternate chain line in FIG. 17, the refrigerant flowed out from the respective tubes 111 which constitute a part of the first leeward core portion 11*a*; is collected to the first refrigerant collecting portion 13*a* of the second leeward tank unit 13, and then flowed into the first lower space 13*c* via the first communicating hole 134. The refrigerant flowed into the first lower space 13*c* flows in the first lower space 13*c* from near the refrigerant inflow portion 12*a* to farther therefrom in the tube stacking direction. The refrigerant flows subsequently into an area, which is positioned relatively far from the refrigerant inflow portion 12*a* in the second windward tank unit 23, via the second communicating portion 32, thereby being distributed to the respective tubes 211 of a windward evaporation portion 20.

In contrast, as illustrated by a broken arrow in FIG. 17, the refrigerant flowed out from the respective tubes 111 which constitute a part of the second leeward core portion 11*b* is collected to the second refrigerant collecting portion 13*b* of the second leeward tank unit 13, and then flowed into the second lower space 13*d* via the second communicating hole 135. The refrigerant flowed into the second lower space 13*d* flows into an area, which is positioned relatively far from the refrigerant inflow portion 12*a* in the second windward tank unit 23, via the first communicating portions 31, thereby being distributed to the respective tubes 211 of the windward evaporation portion 20.

Therefore, when the refrigerant flows through the lower spaces 13*c*, 13*d* of the second leeward tank unit 13, the refrigerant flow is switched in the core portions 11, 21 in the tube stacking direction (in the width direction of the core portions 11, 21). Accordingly, the lower spaces 13*c*, 13*d* of the second leeward tank unit 13 in the present embodiment may be used as an example of a refrigerant flow changing portion.

In the refrigerant flow changing portion, that is, in the lower spaces 13*c*, 13*d* of the second leeward tank unit 13, the flow of the refrigerant from the first refrigerant collecting portion 13*a* to the refrigerant distributing portion 23*c* (second windward tank unit 23) via the second communicating portion 32, and the flow of the refrigerant from the second refrigerant collecting portion 13*b* to the refrigerant distributing portion 23*c* via the first communicating portions 31 are in the non-crossed state when viewed from the longitudinal direction of the tube.

As described thus far, the lower spaces 13*c*, 13*d* of the second leeward tank unit 13 are configured to guide the refrigerant in the first refrigerant collecting portion 13*a* into the refrigerant distributing portion 23*c* via the second communicating portion 32, and guide the refrigerant in the second refrigerant collecting portion 13*b* to the refrigerant distributing portion 23*c* via the first communicating portions 31, so that the flowing direction of the refrigerant may be switched in the width direction of the core portions 11, 21 (in the tube stacking direction) in the second leeward tank unit 13. At this time, since a separate member other than the second leeward tank unit 13 does not need to be provided for switching the flowing direction of the refrigerant, the flowing direction of the refrigerant can be switched in the width direction of the core portions 11, 21 while restricting an increase in a refrigerant sealing amount in the same manner as those in the first embodiment.

Furthermore, in the present embodiment, the refrigerant flow changing portion, that is, the lower spaces 13*c*, 13*d* of the second leeward tank unit 13 are configured in such a manner that the flow of the refrigerant from the first refrigerant collecting portion 13*a* to the refrigerant distributing portion 23*c* via the second communicating portion 32, and the flow of the refrigerant from the second refrigerant collecting portion 13*b* to the refrigerant distributing portion 23*c* via the first communicating portions 31 are in the non-crossed state when viewed from the longitudinal direction of the tube. Accordingly, the capacity to cool the blast air in the refrigerant evaporator 1 can be improved as in the first embodiment.

In addition, in the present embodiment, the first space 130A of the second leeward tank unit 13 does not need to be partitioned into upper and lower parts, and a partitioning portion 231 in the interior of the second windward tank unit 23 may be eliminated. Therefore, the same effects and advantages as the first embodiment are obtained with a simpler configuration while reducing the number of components.

Here, a distribution of a liquid-phase refrigerant in the refrigerant evaporator 1 of the present embodiment will be described with reference to FIG. 18. FIG. 18 is a drawing corresponding to FIG. 7 of the first embodiment.

Figure 18:
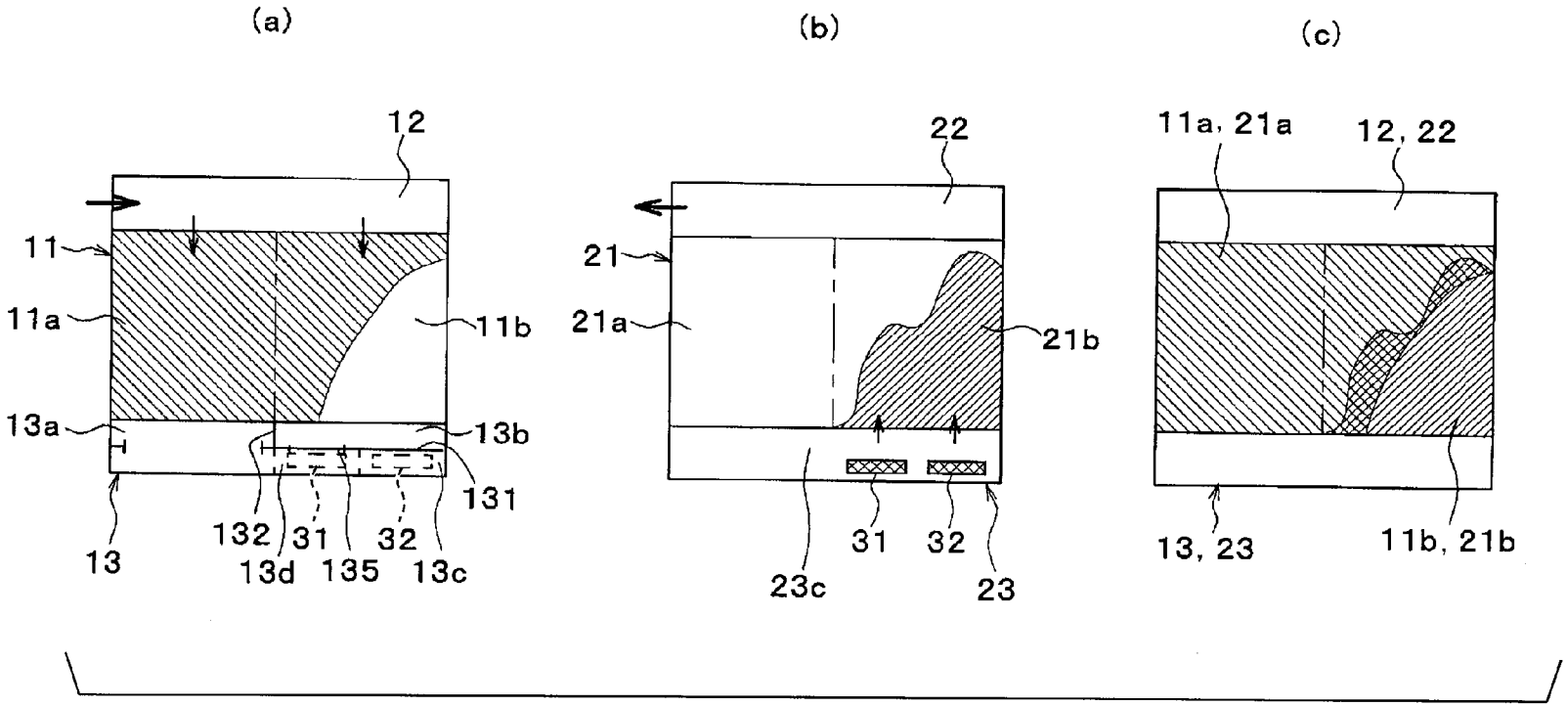
FIG. 18 is diagrams for explaining a distribution of a liquid-phase refrigerant flowing in respective core portions of the refrigerant evaporator according to the fourth embodiment.

As regards the distribution of the liquid-phase refrigerant flowing in the leeward core portion 11, a position where the liquid-phase refrigerant can hardly flow (a hollow portion on the lower right side in the drawings) is generated in the second leeward core portion 11*b* on the side far from the refrigerant inflow portion 12*a* as illustrated in FIG. 18(*a*).

As regards the distribution of the liquid-phase refrigerant flowing in the windward core portion 21, both the first communicating portions 31 and the second communicating portion 32 are connected to the area of the second windward tank unit 23 that is distal from the refrigerant inflow portion 12*a* in the tube stacking direction. Thus, as illustrated in FIG. 18(*b*), the liquid-phase refrigerant is capable of flowing easily to the area of the second windward tank unit 23 that is distal from the refrigerant inflow portion 1*a* in the tube stacking direction.

As illustrated in FIG. 18(*c*), when viewing the refrigerant evaporator 1 of the present embodiment for the flowing direction X of the blast air, the liquid-phase refrigerant flows over the entire area of the portion where the second leeward core portion 11*b* and the second windward core portion 21*b* overlap. In this manner, in the refrigerant evaporator 1 of the present embodiment in which the liquid-phase refrigerant is distributed, the calorific power corresponding to an evaporative latent heat of the refrigerant is absorbed from the blast air by any one of the core portions 11, 21, and hence the blast air can be cooled sufficiently. Consequently, generation of an unbalanced temperature distribution in the blast air passing through the refrigerant evaporator 1 is restricted.

(Other Embodiments)

The present disclosure is not limited to the above-mentioned embodiments, and may have various modifications as described below without departing from the gist of the present disclosure.

(1) In the respective embodiments described above, an example in which a refrigerant flow changing portion is provided in an interior of a second leeward tank unit 13 has been described. However, the invention is not limited thereto, and the refrigerant flow changing portion may be provided in the interior of a second windward tank unit 23 or may be provided in both the second leeward tank unit 13 and the second windward tank unit 23.

(2) In the respective embodiments described above, an example in which a first leeward tank unit 12 and a first windward tank unit 22 are formed integrally, and the second leeward tank unit 13 and a second windward tank unit 23 are formed integrally has been described. However, the invention is not limited thereto, and a configuration in which the first leeward tank unit 12 and the first windward tank unit 22 are provided separately and the second leeward tank unit 13 and the second windward tank unit 23 are provided separately is also applicable.

The invention clamed is:

1. A refrigerant evaporator in which heat exchange is performed between a cooling target fluid flowing outside and a refrigerant, the refrigerant evaporator comprising a first evaporation portion and a second evaporation portion which are arranged in line in a flowing direction of the cooling target fluid, wherein the first evaporation portion includes:

a core portion having a plurality of stacked tubes in which the refrigerant flows; and a pair of tank units connected to both ends of the plurality of tubes and configured to perform collection or distribution of the refrigerant flowing in the plurality of tubes, the second evaporation portion includes:

a core portion having a plurality of stacked tubes in which the refrigerant flows; and a pair of tank units connected to both ends of the plurality of tubes and configured to perform collection or distribution of the refrigerant flowing in the plurality of tubes, the core portion of the first evaporation portion includes a first core portion having a group of the plurality of tubes, and a second core portion having another remaining group of the plurality of tubes, the core portion of the second evaporation portion includes a third core portion having a group of the plurality of tubes opposing at least a part of the first core portion in the flowing direction of the cooling target fluid, and a fourth core portion having a group of the plurality of tubes opposing at least a part of the second core portion in the flowing direction of the cooling target fluid, a first tank unit, which is one of the pair of tank units of the first evaporation portion, includes a first refrigerant collecting portion in which the refrigerant is collected from the first core portion, and a second refrigerant collecting portion in which the refrigerant is collected from the second core portion, a second tank unit, which is one of the pair of tank units of the second evaporation portion, includes a first refrigerant distributing portion from which the refrigerant is distributed to the third core portion, and a second refrigerant distributing portion from which the refrigerant is distributed to the fourth core portion, the second refrigerant collecting portion and the first refrigerant distributing portion are connected through a first communicating portion, the first refrigerant collecting portion and the second refrigerant distributing portion are connected through a second communicating portion, at least one of the first tank unit of the first evaporation portion and the second tank unit of the second evaporation portion includes therein a refrigerant flow changing portion guiding the refrigerant from the first refrigerant collecting portion to the second refrigerant distributing portion and guiding the refrigerant from the second refrigerant collecting portion to the first refrigerant distributing portion, the refrigerant flow changing portion is configured such that the refrigerant flow from the first refrigerant collecting portion to the second refrigerant distributing portion and the refrigerant flow from the second refrigerant collecting portion to the first refrigerant distributing portion are in a non-crossed state when viewed in a longitudinal direction of the tubes, a third tank unit, which is another of the pair of tank units of the first evaporation portion, includes a refrigerant inflow portion configured to introduce the refrigerant into the interior of the third tank unit, the refrigerant inflow portion is located at a position closer to the first core portion than to the second core portion, the second communicating portion is connected to one end of the second tank unit of the second evaporation portion in a stacking direction of the tubes, the one end of the second tank unit is farther from the refrigerant inflow portion than another end of the second tank unit in the stacking direction of the tubes is from the refrigerant inflow portion, the plurality of tubes are configured to cause the refrigerant to flow in a vertical direction, the first tank unit of the first evaporation portion includes:

a first partitioning member configured to partition an internal space of the first tank unit into an upper space and a lower space;

a second partitioning member configured to partition the upper space into two spaces in the stacking direction of the tubes; and a third partitioning member configured to partition at least a part of the lower space into two spaces in the flowing direction of the cooling target fluid, one of the two upper spaces partitioned by the second partitioning member forms the first refrigerant collecting portion and another of the two upper spaces forms the second refrigerant collecting portion, one of the two lower spaces partitioned by the third partitioning member communicates with both the first refrigerant collecting portion and the second refrigerant distributing portion, and another of the two lower spaces communicates with both the second refrigerant collecting portion and the first refrigerant distributing portion, and the two lower spaces partitioned by the third partitioning member form the refrigerant flow changing portion.

2. The refrigerant evaporator according to claim 1, wherein the third partitioning member includes:

a first member configured to partition a part of the lower space into two parts in the flowing direction of the cooling target fluid; and a second member connected to the first member and extending toward the second tank unit of the second evaporation portion, the first member is connected to an end part of the first tank unit of the first evaporation portion, the end part of the first tank unit being positioned on a closer side of the first tank unit to the refrigerant inflow portion in the stacking direction of the tubes, and the one of the two lower spaces partitioned by the third partitioning member has a substantially L-shape when viewed from the longitudinal direction of the tubes.

3. A refrigerant evaporator in which heat exchange is performed between a cooling target fluid flowing outside and a refrigerant, the refrigerant evaporator comprising a first evaporation portion and a second evaporation portion which are arranged in line in a flowing direction of the cooling target fluid, wherein the first evaporation portion includes:

a core portion having a plurality of stacked tubes in which the refrigerant flows; and a pair of tank units connected to both ends of the plurality of tubes and configured to perform collection or distribution of the refrigerant flowing in the plurality of tubes, the second evaporation portion includes:

a core portion having a plurality of stacked tubes in which the refrigerant flows; and a pair of tank units connected to both ends of the plurality of tubes and configured to perform collection or distribution of the refrigerant flowing in the plurality of tubes, the core portion of the first evaporation portion includes a first core portion having a group of the plurality of tubes, and a second core portion having another remaining group of the plurality of tubes, the core portion of the second evaporation portion includes a third core portion having a group of the plurality of tubes opposing at least a part of the first core portion in the flowing direction of the cooling target fluid, and a fourth core portion having a group of the plurality of tubes opposing at least a part of the second core portion in the flowing direction of the cooling target fluid, a first tank unit, which is one of the pair of tank units of the first evaporation portion, includes a first refrigerant collecting portion in which the refrigerant is collected from the first core portion, and a second refrigerant collecting portion in which the refrigerant is collected from the second core portion, a third tank unit, which is another of the pair of tank units of the first evaporation portion, includes a refrigerant inflow portion configured to introduce the refrigerant into the interior of the third tank unit, the refrigerant inflow portion is located at a position closer to the first core portion than to the second core portion, a second tank unit, which is one of the pair of tank units of the second evaporation portion, is connected to a first communicating portion through which the refrigerant flows from the second refrigerant collecting portion into the second tank unit, and a second communicating portion through which the refrigerant flows from the first refrigerant collecting portion into the second tank unit, the first communicating portion and the second communicating portion are arranged on the second tank unit of the second evaporation portion at positions corresponding to the fourth core portion, both the first communicating portion and the second communicating portion communicating with the fourth core portion, the first communicating portion is arranged to be closer to the third core portion than the second communicating portion is to the third core portion, at least one of the first tank unit of the first evaporation portion and the second tank unit of the second evaporation portion includes therein a refrigerant flow changing portion guiding the refrigerant from the first refrigerant collecting portion to the second communicating portion and guiding the refrigerant from the second refrigerant collecting portion to the first communicating portion, and the refrigerant flow changing portion is configured such that the refrigerant flow from the first refrigerant collecting portion to the second communicating portion and the refrigerant flow from the second refrigerant collecting portion to the first communicating portion are in a non-crossed state when viewed from a longitudinal direction of the tubes.

* * * * *